US010239312B2

(12) United States Patent
Mizukami

(10) Patent No.: US 10,239,312 B2
(45) Date of Patent: Mar. 26, 2019

(54) LIQUID DISCHARGE HEAD, LIQUID DISCHARGE DEVICE, AND LIQUID DISCHARGE APPARATUS

(71) Applicant: Satoshi Mizukami, Kanagawa (JP)

(72) Inventor: Satoshi Mizukami, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/919,457

(22) Filed: Mar. 13, 2018

(65) Prior Publication Data

US 2018/0264809 A1 Sep. 20, 2018

(30) Foreign Application Priority Data

Mar. 17, 2017 (JP) ..... 2017-053293
Mar. 17, 2017 (JP) ..... 2017-053323
Feb. 13, 2018 (JP) ..... 2018-023119
Feb. 13, 2018 (JP) ..... 2018-023136

(51) Int. Cl.
*B41J 2/045* (2006.01)
*B41J 2/14* (2006.01)
*B41J 2/16* (2006.01)

(52) U.S. Cl.
CPC ..... *B41J 2/04581* (2013.01); *B41J 2/04573* (2013.01); *B41J 2/14233* (2013.01); *B41J 2/161* (2013.01); *B41J 2/1628* (2013.01); *B41J 2/1642* (2013.01); *B41J 2/1645* (2013.01); *B41J 2002/14258* (2013.01); *B41J 2202/03* (2013.01)

(58) Field of Classification Search
CPC ..... B41J 2/04581; B41J 2/14233; B41J 2202/11; B41J 2/161; B41J 2/1628
USPC ..... 347/68, 70–72
See application file for complete search history.

(56) References Cited

U.S. PATENT DOCUMENTS 7,708,389 B2 * 5/2010 Murai ..... B41J 2/14233 347/69
7,857,431 B2 * 12/2010 Fukui ..... B41J 2/161 347/68
9,597,872 B2 * 3/2017 Mizukami ..... B41J 2/14233
2011/0090289 A1 4/2011 Mizukami
(Continued)

FOREIGN PATENT DOCUMENTS

JP 2001-088308 4/2001
JP 2001-088309 4/2001
(Continued)

*Primary Examiner* — An Do
(74) *Attorney, Agent, or Firm* — Oblon, McClelland, Maier & Neustadt, L.L.P.

(57) ABSTRACT

A liquid discharge head includes a plurality of nozzles from which a liquid is discharged, a plurality of pressure chambers communicating with the plurality of nozzles, respectively, a substrate in which the plurality of pressure chamber is arranged in a predetermined direction, a diaphragm provided on a first side of the substrate opposite a second side of the substrate facing the plurality of nozzles, the diaphragm forming walls of the plurality of pressure chambers, and a plurality of electromechanical transducer elements provided on the diaphragm corresponding to the plurality of pressure chambers, respectively. A groove is formed in the substrate on an end side of the plurality of pressure chambers in the predetermined direction, and the groove includes an opening that opens toward a direction opposite to the diaphragm.

20 Claims, 21 Drawing Sheets

(56) References Cited

U.S. PATENT DOCUMENTS

| | | | |
|---|---|---|---|
| 2012/0212545 | A1 | 8/2012 | Mizukami et al. |
| 2012/0229573 | A1 | 9/2012 | Mizukami et al. |
| 2012/0236083 | A1 | 9/2012 | Mizukami et al. |
| 2013/0002767 | A1 | 1/2013 | Mizukami et al. |
| 2013/0070029 | A1 | 3/2013 | Mizukami et al. |
| 2013/0162726 | A1 | 6/2013 | Mizukami et al. |
| 2013/0250007 | A1 | 9/2013 | Ishimori et al. |
| 2013/0250009 | A1 | 9/2013 | Ishimori et al. |
| 2015/0077475 | A1 | 3/2015 | Mizukami et al. |
| 2015/0349240 | A1 | 12/2015 | Mizukami |
| 2016/0099402 | A1 | 4/2016 | Mizukami et al. |
| 2016/0167383 | A1 | 6/2016 | Mizukami |
| 2016/0236470 | A1 | 8/2016 | Mizukami |
| 2016/0263892 | A1 | 9/2016 | Mizukami |
| 2016/0263893 | A1 | 9/2016 | Mizukami et al. |
| 2016/0351788 | A1 | 12/2016 | Mizukami |
| 2017/0173955 | A1 | 6/2017 | Mizukami |
| 2017/0291419 | A1 | 10/2017 | Mizukami |
| 2017/0334205 | A1 | 11/2017 | Mizukami |

FOREIGN PATENT DOCUMENTS

| | | |
|---|---|---|
| JP | 2001-277503 | 10/2001 |
| JP | 2005-284375 | 10/2005 |
| JP | 2009-259153 | 11/2009 |
| JP | 2014-124935 | 7/2014 |
| JP | 2014-177035 | 9/2014 |

* cited by examiner

FIG. 27A

FIG. 27 | FIG. 27A | FIG. 27B

| | NUMBER OF DUMMY CHANNELS | DISTANCE OF GROOVE OF DUMMY CHANNELS | DISTANCE OF GROOVE OF END CHANNEL | CURVATURE RADIUS OF GROOVE | CURVATURE RADIUS OF END DRIVE CHANNEL | GROOVE: X1 | GROOVE: Y1 | INTERVAL OF GROOVE: X1 | INTERVAL OF GROOVE: Y1 |
|---|---|---|---|---|---|---|---|---|---|
| EXAMPLE 1 | 1 | 60 μm | | 6300 μm | 4500 μm | 60 μm | 60 μm | 60 μm | 60 μm |
| EXAMPLE 2 | 4 | 60 μm | | 8400 μm | 4200 μm | 60 μm | 60 μm | 60 μm | 60 μm |
| EXAMPLE 3 | 4 | 30 μm | | 6200 μm | 4250 μm | 100 μm | 100 μm | 30 μm | 30 μm |
| EXAMPLE 4 | 0 | | 100 μm | 6400 μm | 4300 μm | 60 μm | 60 μm | 60 μm | 60 μm |
| EXAMPLE 5 | 4 | 60 μm | | | 4400 μm | 60 μm | 60 μm | 60 μm | 60 μm |
| EXAMPLE 6 | 4 | 60 μm | | 5200 μm | 4100 μm | 60 μm | 60 μm | 60 μm | 60 μm |
| COMPARATIVE EXAMPLE 1 | 4 | | | | 4600 μm | | | | |
| COMPARATIVE EXAMPLE 2 | 0 | | | | 4350 μm | | | | |

FIG. 27B

| DIFFERENCE OF CURVATURE RADIUS | DIFFERENCE OF DISPLACEMENT | NOZZLE BONDING PROPERTY | FILLING PROPERTY |
|---|---|---|---|
| 1000 μm | 6.0 % | EXCELLENT | GOOD |
| 300 μm | 2.0 % | EXCELLENT | EXCELLENT |
| 1450 μm | 8.0 % | EXCELLENT | EXCELLENT |
| 800 μm | 6.0 % | EXCELLENT | FAIR |
| 100 μm | 0.5 % | EXCELLENT | EXCELLENT |
| 1480 μm | 7.9 % | EXCELLENT | EXCELLENT |
| 2500 μm | 13.0 % | POOR | EXCELLENT |
| 300 μm | 2.0 % | POOR | FAIR |

FIG. 28A

FIG. 28 | FIG. 28A | FIG. 28B

| | NUMBER OF DUMMY CHANNELS | DISTANCE OF GROOVE OF DUMMY CHANNELS | DISTANCE OF GROOVE OF END CHANNEL | CURVATURE RADIUS OF GROOVE | CURVATURE RADIUS OF END DRIVE CHANNEL | GROOVE: X1 | GROOVE: Y1 | INTERVAL OF GROOVE: X1 | INTERVAL OF GROOVE: Y1 |
|---|---|---|---|---|---|---|---|---|---|
| EXAMPLE 7 | 1 | 60 μm | | 2300 μm | 4500 μm | 60 μm | 60 μm | 60 μm | 60 μm |
| EXAMPLE 8 | 4 | 60 μm | | 6400 μm | 4200 μm | 60 μm | 60 μm | 60 μm | 60 μm |
| EXAMPLE 9 | 4 | 30 μm | | 6200 μm | 4250 μm | 100 μm | 100 μm | 30 μm | 30 μm |
| EXAMPLE 10 | 0 | | 100 μm | 6500 μm | 4300 μm | 60 μm | 60 μm | 60 μm | 60 μm |
| EXAMPLE 11 | 4 | 60 μm | | | 4400 μm | 60 μm | 60 μm | 60 μm | 60 μm |
| COMPARATIVE EXAMPLE 3 | 4 | 60 μm | | 1200 μm | 4600 μm | 60 μm | 60 μm | 60 μm | 60 μm |
| COMPARATIVE EXAMPLE 4 | 0 | | | | 4350 μm | | | | |

FIG. 28B

| DIFFERENCE OF CURVATURE RADIUS | DIFFERENCE OF DISPLACEMENT | NOZZLE BONDING PROPERTY | FILLING PROPERTY |
|---|---|---|---|
| 1450 μm | 7.9 % | EXCELLENT | GOOD |
| 300 μm | 2.0 % | EXCELLENT | EXCELLENT |
| 930 μm | 4.3 % | EXCELLENT | EXCELLENT |
| 800 μm | 3.6 % | EXCELLENT | FAIR |
| 100 μm | 0.5 % | EXCELLENT | EXCELLENT |
| 2500 μm | 13.0 % | POOR | EXCELLENT |
| 300 μm | 2.0 % | POOR | FAIR |

LIQUID DISCHARGE HEAD, LIQUID DISCHARGE DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2017-053293, filed on Mar. 17, 2017, in the Japan Patent Office, Japanese Patent Application No. 2017-053323, filed on Mar. 17, 2017, in the Japan Patent Office, Japanese Patent Application No. 2018-023119, filed on Feb. 13, 2018, in the Japan Patent Office, Japanese Patent Application No. 2018-023136, filed on Feb. 13, 2018, in the Japan Patent Office, the entire disclosure of which are hereby incorporated by reference herein.

BACKGROUND

Technical Field

Aspects of the present disclosure relate to a liquid discharge head, a liquid discharge device, and a liquid discharge apparatus.

Related Art

Liquid discharging heads are known that include nozzles to discharge liquid droplets such as ink, pressure chambers communicating with the nozzles, and electromechanical transducer elements such as piezoelectric elements to pressurize liquid inside the pressure chambers. Two types of liquid discharge heads are used: a liquid discharge head using piezoelectric actuators vibrating in a longitudinal vibration mode and the liquid discharge head using piezoelectric actuators vibrating in a flexural vibration mode.

As the liquid discharge head using the piezoelectric actuators vibrating in the flexural vibration mode, for example, a head is known that is manufactured by the following procedure. First, a uniform piezoelectric material layer is formed by a film forming technique over the entire surface of a diaphragm. Then, the piezoelectric material layer is cut into a shape corresponding to pressure chambers by a lithography method to form independent electromechanical transducer elements for the respective pressure chambers.

One of the liquid discharge head including the piezoelectric actuators vibrating in the flexural vibrating mode includes a groove formed on a surface of a channel substrate on a side of a nozzle substrate.

SUMMARY

In an aspect of this disclosure, a liquid discharge head includes a plurality of nozzles from which a liquid is discharged, a plurality of pressure chambers communicating with the plurality of nozzles, respectively, a substrate in which the plurality of pressure chamber is arranged in a predetermined direction, a diaphragm provided on a first side of the substrate opposite a second side of the substrate facing the plurality of nozzles, the diaphragm forming walls of the plurality of pressure chambers, and a plurality of electromechanical transducer elements provided on the diaphragm corresponding to the plurality of pressure chambers, respectively. A groove is formed in the substrate on an end side of the plurality of pressure chambers in the predetermined direction, and the groove includes an opening that opens toward a direction opposite to the diaphragm. The diaphragm at the plurality of pressure chambers is formed to be deflexed toward the plurality of pressure chambers, and the diaphragm at the groove is formed to be deflexed opposite to the opening of the groove. A degree of deflection of the diaphragm at the plurality of pressure chambers is larger than a degree of deflection of the diaphragm at the groove.

In another aspect of this disclosure, a liquid discharge head includes a plurality of nozzles from which a liquid is discharged, a plurality of pressure chambers communicating with the plurality of nozzles, respectively, a substrate in which the plurality of pressure chamber is arranged in a predetermined direction, a diaphragm provided on a first side of the substrate opposite a second side of the substrate facing the plurality of nozzles, the diaphragm forming walls of the plurality of pressure chambers, and a plurality of electromechanical transducer elements provided on the diaphragm corresponding to the plurality of pressure chambers, respectively. A groove is formed in the substrate on an end side of the plurality of pressure chambers in the predetermined direction, and the groove includes an opening that opens toward a direction opposite to the diaphragm. The diaphragm at the groove is formed to be deflexed opposite to the opening of the groove, and a radius of curvature Ra of the diaphragm at the groove is equal to or larger than 5000 μm.

In still another aspect of this disclosure, a liquid discharge apparatus includes a plurality of nozzles from which a liquid is discharged, a plurality of pressure chambers communicating with the plurality of nozzles, respectively, a substrate in which the plurality of pressure chamber is arranged in a predetermined direction, a diaphragm provided on a first side of the substrate opposite a second side of the substrate facing the plurality of nozzles, the diaphragm forming walls of the plurality of pressure chambers, and a plurality of electromechanical transducer elements provided on the diaphragm corresponding to the plurality of pressure chambers, respectively. A groove is formed in the substrate on an end side of the plurality of pressure chambers in the predetermined direction, and the groove includes an opening that opens toward a direction opposite to the diaphragm. The diaphragm at the plurality of pressure chambers is formed to be deflexed toward the plurality of pressure chambers, and the diaphragm at the groove is formed to be deflexed opposite to the opening of the groove.

BRIEF DESCRIPTION OF THE DRAWINGS

The aforementioned and other aspects, features, and advantages of the present disclosure will be better understood by reference to the following detailed description when considered in connection with the accompanying drawings, wherein:

FIGS. 27A and 27B (collectively referred to as FIG. 27) are tables illustrate an evaluation results and details of each Examples and Comparative Examples; and FIGS. 28A and 28B (collectively referred to as FIG. 28) are tables illustrate evaluation results and details of each Examples and Comparative Examples.

Figure 1:
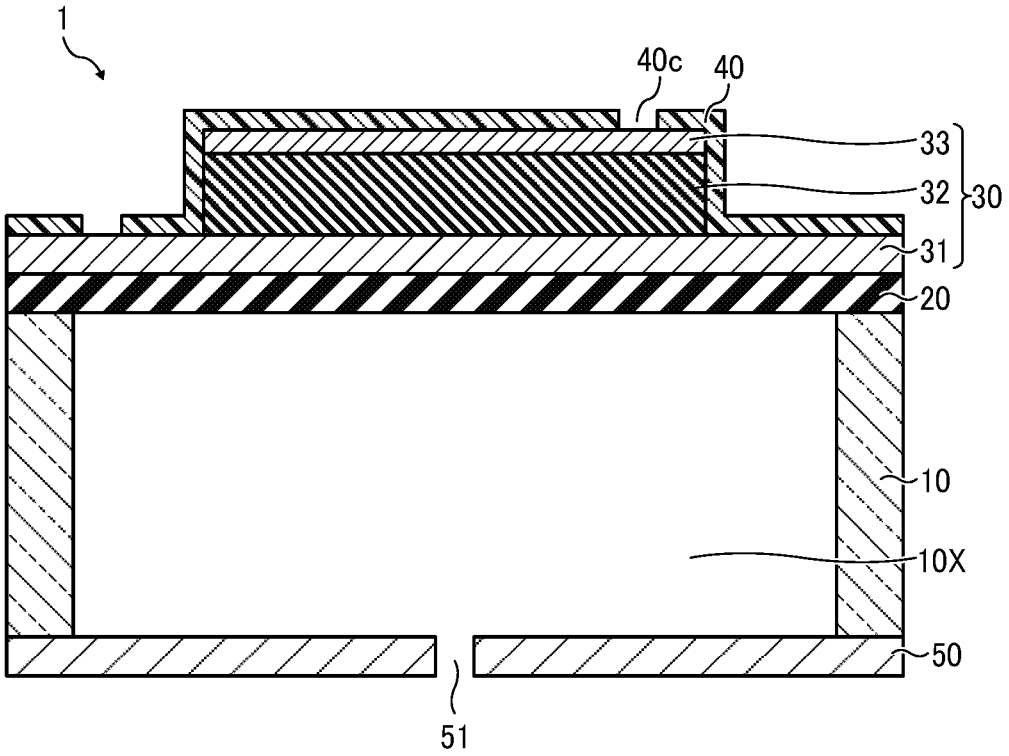
FIG. 1 is a cross-sectional view of a liquid discharge head according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Hereinafter, embodiments of the present disclosure are described with reference to the attached drawings. A liquid discharge head according to an embodiment of the present disclosure is described with reference to FIGS. 1 through 3.

Configurations of embodiments according to the present disclosure are described below with reference to FIGS. 1 to 24.

[Liquid Discharge Head]

First Embodiment

[Configuration of Liquid Discharge Head]

FIG. 1 is an enlarged cross-sectional view of a liquid discharge head 1 according to an embodiment of the present disclosure. Hereinafter, the "liquid discharge head" is simply referred to as "head". The head 1 includes a substrate 10, a diaphragm 20, an electromechanical transducer element 30, and an insulating protective film 40. Further, the electromechanical transducer element 30 includes a lower electrode 31, an electromechanical transducer film 32, and an upper electrode 33.

In the head 1, the diaphragm 20 is formed on the substrate 10, and a lower electrode 31 of the electromechanical transducer element 30 is formed on the diaphragm 20. Further, an electromechanical transducer film 32 is formed in a predetermined region of the lower electrode 31, and an upper electrode 33 is further formed on the electromechanical transducer film 32. The insulating protective film 40 covers the electromechanical transducer element 30. The insulating protective film 40 has an opening 40*c* for selectively exposing the lower electrode 31 and the upper electrode 33, and a wiring can be drawn from the lower electrode 31 and the upper electrode 33 via the opening 40*c*.

A nozzle plate 50 including a nozzle 51 from which ink droplets are discharged is joined to the lower portion of the substrate 10. The nozzle plate 50, the substrate 10, and the diaphragm 20 form a pressure chamber 10X communicating with the nozzle 51. The pressure chamber 10X is also referred to as an ink channel, a pressure liquid chamber, a pressurizing chamber, a discharge chamber, and a liquid chamber, for example. The diaphragm 20 forms a part of a wall surface of the pressure chamber 10X. In other words, the pressure chamber 10X is partitioned by the substrate 10 (constituting the side surfaces), the nozzle plate 50 (constituting the lower surface), and the diaphragm 20 (constituting the upper surface). The pressure chamber 10X communicates with the nozzle 51.

The diaphragm 20 is provided on a first side of the substrate 10 opposite a second side of the substrate 10 facing the plurality of nozzles 51. The diaphragm 20 forms walls of the plurality of pressure chambers 10X.

Figure 2:
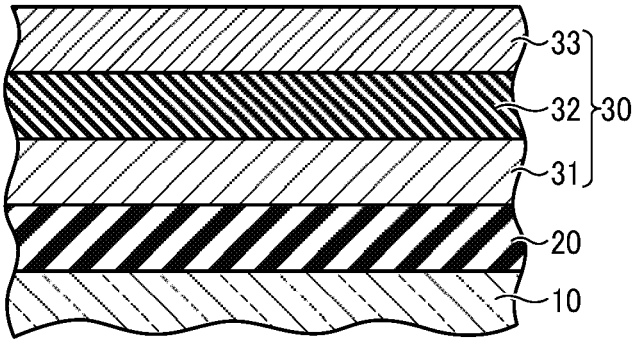
FIG. 2 is a cross-sectional view of a portion of the liquid discharge head during a manufacturing process.

FIG. 2 illustrates a method for manufacturing the head 1. First, the diaphragm 20, the lower electrode 31, the electromechanical transducer film 32, and the upper electrode 33 are sequentially laminated on the substrate 10 as illustrated in FIG. 2. Then, the lower electrode 31, the electromechanical transducer film 32, and the upper electrode 33 are etched to have a desired shape. Then, the lower electrode 31, the electromechanical transducer film 32, and the upper electrode 33 are covered with the insulating protective film 40. Then, the opening 40*c* for selectively exposing the lower electrode 31 and the upper electrode 33 is formed in the insulating protective film 40. Then, the pressure chamber 10X is formed by etching the substrate 10 from a lower side of the substrate 10. Next, the nozzle plate 50 including the nozzles 51 is bonded to the lower surface of the substrate 10 so that manufacturing of the head 1 is completed.

Figure 3:
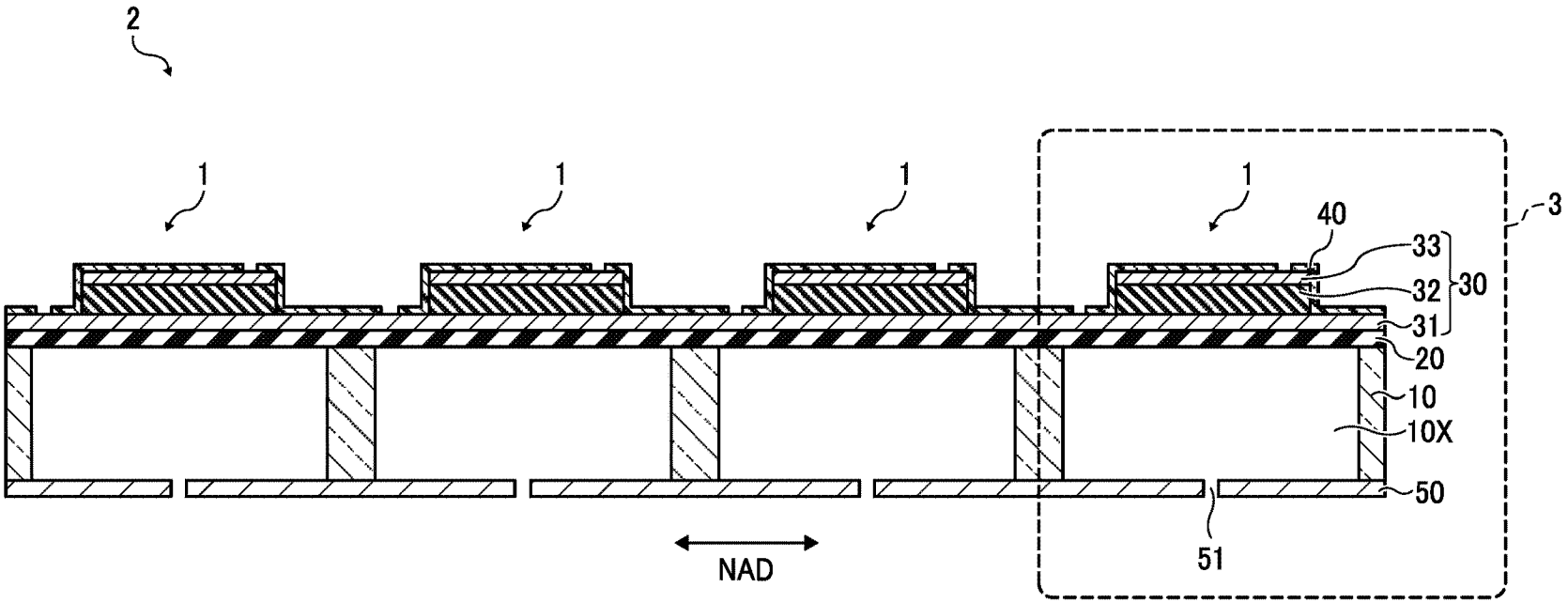
FIG. 3 is a cross-sectional view of the liquid discharge head.

FIG. 3 is a cross-sectional view of an actual head 2. Only one head 1 is illustrated in FIG. 1. However, the actual head 2 includes a plurality of heads 1 arranged in a nozzle array direction indicated by arrow NAD in FIG. 3. A plurality of nozzles 51 of the heads 1 is arrayed in a row in the nozzle array direction NAD. The head 2 has a structure in which a plurality of heads 1 are arrayed in the nozzle array direction NAD. The head 1 includes the nozzle 51 for discharge liquid, the pressure chamber 10X communicating with the nozzle 51, and a discharge driver to increase a pressure of the liquid in the pressure chamber 10X. Here, the discharge driver includes the diaphragm 20 that forms a part of the wall of the pressure chamber 10X and the electromechanical transducer element 30 including the electromechanical transducer film 32.

In the head 2, a portion of the head 1 including the pressure chamber 10X, the diaphragm 20, and the electromechanical transducer element 30 for discharging the liquid is referred to as a drive channel 3.

Figure 4A:
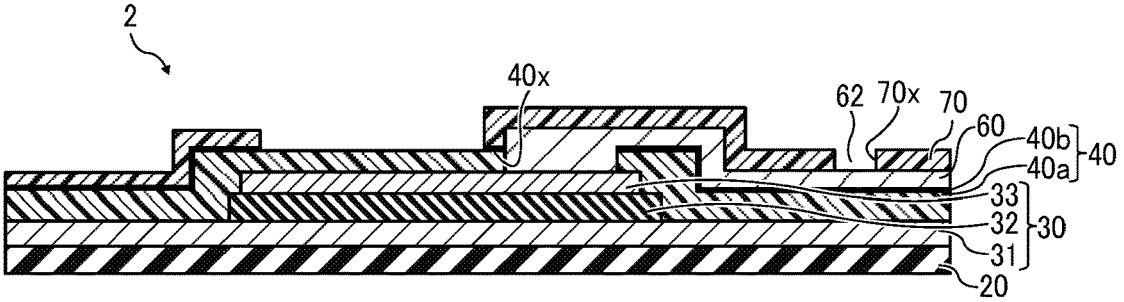
FIGS. 4A and 4B illustrate an example of parts such as a wiring of the liquid discharge head.
Figure 4B:
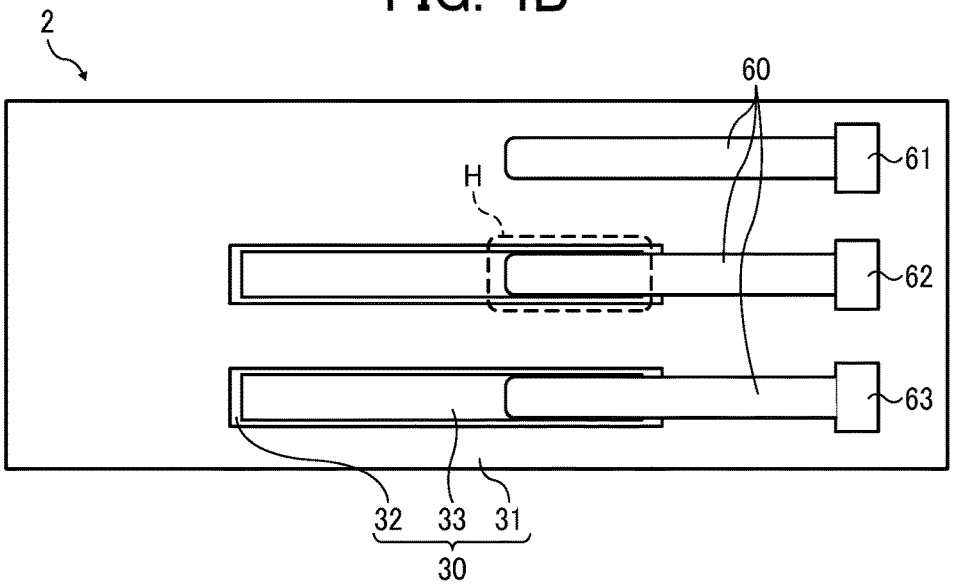

Next, a configuration of the head 2 including a wiring, for example, is described with reference to FIGS. 4A and 4B. FIGS. 4A and 4B illustrate an example of parts such as the wiring of the head 2. FIG. 4A is a cross-sectional view of the head 2. FIG. 4B is a plan view of the head 2. Here the insulating protective film 40 and 70 are omitted in FIG. 4B.

In an example illustrated in FIGS. 4A and 4B, the insulating protective film 40 is formed of two layers of insulating protective films 40*a* and 40*b*. A plurality of wirings 60 is provided on a second layer of the insulating protective film 40*b*, and an insulating protective film 70 is further provided over the wirings 60. The insulating protective film 40 has a plurality of openings 40*x*. The surface of the lower electrode 31 or the upper electrode 33 is exposed in the opening 40*x*. The wiring 60 includes a wiring connected to the upper electrode 33 via the opening 40*x* (a portion of a contact hole H in FIG. 4B) and a wiring connected to the lower electrode 31 via the opening 40*x*.

The insulating protective film 70 includes a plurality of openings 70*x*, and surfaces of the wirings 60 are exposed in the openings 70*x*, respectively. Each of the wirings 60 exposed in the openings 70*x* becomes the electrode pads 61, 62, and 63. The electrode pad 61 is a common electrode pad and is connected to the lower electrode 31 via the wiring 60. The lower electrode 31 is common to each of the electromechanical transducer elements 30. The electrode pads 62 and 63 are individual electrode pads and are connected to the upper electrodes 33 via the wirings 60, respectively. The upper electrodes 33 are independent for each electromechanical transducer elements 30.

[Deflection (Curvature) of Diaphragm]

Figure 5:
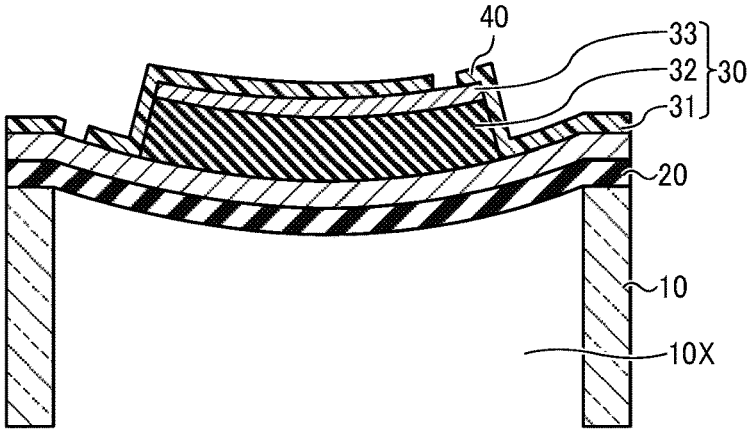
FIG. 5 is a cross-sectional view of the liquid discharge head illustrating a deflection of a diaphragm.

In a process of manufacturing the head 2, the diaphragm 20 deflects (curved) so that the diaphragm 20 is convex toward the pressure chamber 10X side as illustrated in FIG. 5 when the pressure chamber 10X is manufactured. That is, in a state where no voltage is applied to the electromechanical transducer element 30, the diaphragm 20 deflects (curved) to be convex toward the pressure chamber 10X side. Therefore, the diaphragm 20 is formed in a state in which the diaphragm 20 deflects in a convex shape toward the pressure chamber 10X side. An amount of deflection of the diaphragm 20 influences a displacement amount of the diaphragm 20. Further, when the diaphragm 20 deflects, residual vibration occurs when the head 2 discharges ink. Generation of a predetermined waveform is necessary to suppress the residual vibration. However, reducing a frequency of the predetermined waveform is necessary to suppress the residual vibration. Thus, securing discharge performance of the head 2 at high frequency becomes difficult.

To secure discharge performance at a high frequency, a rigidity of the diaphragm 20, electromechanical transducer film 32, and the insulating protective film 40 has to be increased. Thus, it is necessary to use material having high Young's ratio or using material having a large film thickness for the diaphragm 20, the electromechanical transducer film 32, and the insulating protective film 40. In the head 2, the diaphragm 20 is formed from a plurality of layers including materials such as a silicon oxide film ($SiO_2$), a silicon nitride film (SiN), and polysilicon (Poly-Si) in consideration of stress design. Thickness of the diaphragm 20 is preferably in a range of from 1 μm or greater and 3 μm or less. Further, setting the Young's modulus of the diaphragm 20 to be equal to 75 GPa or more and 95 GPa or less can secure a discharging performance at a high frequency.

Figure 6A:
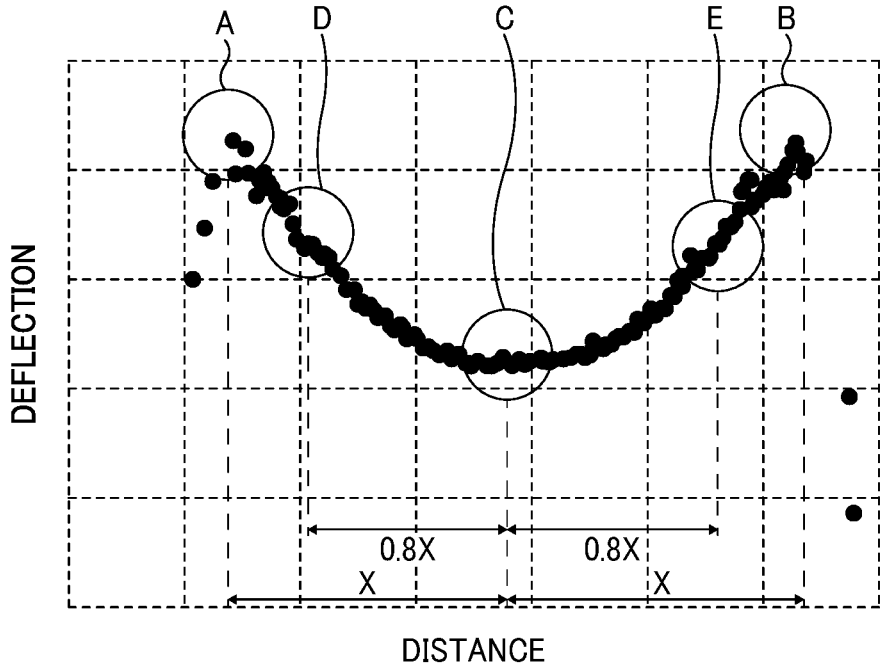
FIGS. 6A and 6B are a graph illustrating the deflection of the diaphragm.

Next, an amount of deflection of the diaphragm 20 is described below. A definition of the amount of deflection of the diaphragm 20 is described with reference to FIG. 6. In order to calculate the deflection amount of the diaphragm 20, a deflection distribution of the diaphragm 20 illustrated in FIG. 6A is acquired from the pressure chamber 10X side using a deflection amount meter (CCI 3000, manufactured by Ametec Corporation).

Calculation of a radius of curvature R of the diaphragm 20 based on the acquired deflection distribution is described below. As illustrated in FIG. 5 as an example, a central portion of the diaphragm 20 has a large deflection, and both ends of the diaphragm have a small deflection. Next, a point C that is a center point of the deflection of the diaphragm 20 is obtained based on points A and B disposed at both ends of the diaphragm 20 in the deflection distribution of the diaphragm 20 illustrated in FIG. 6A acquired using the deflection amount meter. The deflection amount at each points A and B becomes the smallest in the diaphragm 20. Then, a distance X between the center point C and each of the points A and B at both ends of the diaphragm 20 is obtained. Then, two points D and E at a distance of 0.8X are obtained with reference to the center point C of the deflection. Next, as illustrated FIG. 6B, a point F of intersection between a line DE connecting the point D and the point E and a line perpendicular to the line DE and passing the center point C is obtained. Then, a distance Y between the point F and the point C is obtained. This distance Y can be obtained from a difference between a height at the points D and E and the height at the center point C in the deflection distribution. Further, a distance between a point O and the point F can be calculated by determining the point O of a center of a curvature circle of the deflection. Thus, the radius of curvature R can be calculated using the pythagoran theorem in a right triangle composed of the points O, E, and F.

Figure 6B:
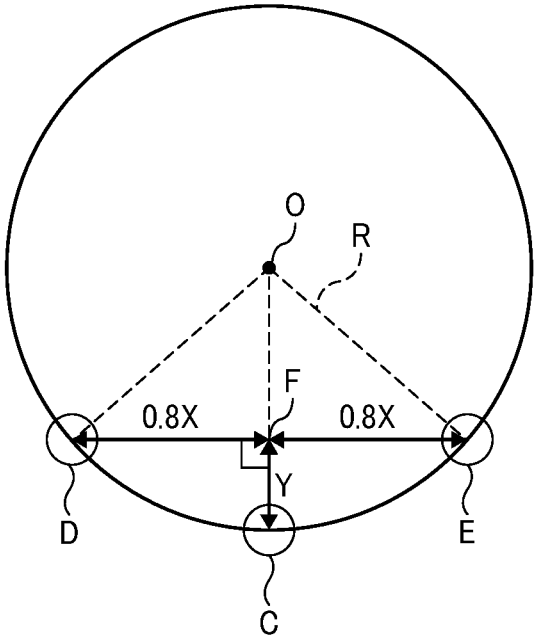

In the following description, the radius of curvature R is calculated by the above calculation method unless otherwise specified. The method of calculating the radius of curvature R of the diaphragm 20 is not limited to the method as illustrated in FIGS. 6A and 6B. For example, the center point C in the deflection distribution of the diaphragm 20 is obtained. Then, the radius of curvature R is calculated based on two or three coordinate points separated from the center point C by a predetermined distance in a direction from the center point C to the points A and B of both ends of the diaphragm 20.

[Material for Liquid Discharge Head]

Next, preferred materials for constituting the head 2 are described below. A silicon single crystal substrate is preferably used as the substrate 10, and the substrate 10 preferably has a thickness of from 100 μm to 600 μm. As plane orientations, three kinds of (100), (110), and (111) are known. However, (100) and (111) are generally used widely in the semiconductor industry. In the head 2 of the present embodiment, a silicon single crystal substrate mainly having (100) plane orientation is used.

In fabricating the pressure chamber 10X, the silicon single crystal substrate is processed by etching. In such a case, an anisotropic etching is typically used as a method of etching. The anisotropic etching utilizes the property in which the etching rate is different between plane orientations of crystal structure.

For example, in the anisotropic etching in which a substrate is immersed in an alkaline solution, such as KOH, the etching rate of a (111) plane is about 1/400 of the etching rate of a (100) plane. Therefore, a structure having an inclination of about 54° can be produced in the plane orientation (100). On the other hand, a deep groove can be formed in the plane orientation (110). Therefore, a single crystal substrate having a plane orientation of (110) may also be used for the head 2 since an array density can be increased while maintaining more rigidity. However, it should be noted that in this case, a mask material $SiO_2$ is also etched.

The width (length in a short direction) of the pressure chamber 10X is preferably from 50 μm to 250 μm and more preferably from 60 μm to 150 μm.

The diaphragm 20 is deformed and displaced by receiving a force generated by the electromechanical transducer film 32, and discharges an ink droplet in the pressure chamber 10X. Therefore, a material having predetermined strength is preferably used as the diaphragm 20. As the materials of the diaphragm 20, for example, Si, $SiO_2$, and $Si_3N_4$ are prepared according to a chemical vapor deposition (CVD) method. A material having a linear expansion coefficient close to the linear expansion coefficient of each of the lower electrode 31 and the electromechanical transducer film 32 is preferably selected for the diaphragm 20.

As a material of the electromechanical transducer film 32, in which PZT is typically used, the diaphragm 20 may be made of a material having a linear expansion coefficient of from $5\times10^{-6}$ to $10\times10^{-6}$ [1/K] close to a linear expansion coefficient of $8\times10^{-6}$ [1/K]. Furthermore, a material having a linear expansion coefficient of $7\times10^{-6}$ to $9\times10^{-6}$ [1/K] is more preferable.

Examples of the materials of the diaphragm 20 include aluminum oxide, zirconium oxide, iridium oxide, ruthenium oxide, tantalum oxide, hafnium oxide, osmium oxide, rhenium oxide, rhodium oxide, palladium oxide, and compounds of the foregoing materials. Using such materials, the diaphragm 20 can be produced by a sputtering method or a spin coater using a sol-gel method.

The film thickness of the diaphragm 20 is preferably in a range of from 1 μm to 10 μm, and more preferably in a range of from 2 μm to 5 μm.

Examples of a metal material of the lower electrode 31 and the upper electrode 33 include platinum having high heat-resistance and low reactivity. However, platinum may not have a sufficient barrier property against lead. Accordingly, platinum group elements, such as iridium and platinum-rhodium, or alloy films of the platinum group elements may be used for the lower electrode 31 and the upper electrode 33.

When platinum is used as the material for the lower electrode 31 and the upper electrode 33, adhesion of platinum with the diaphragm 20 (in particular, $SiO_2$) as a base is poor. Therefore, the lower electrode 31 and the upper electrode 33 are preferably laminated via an adhesive layer composed of material, for example, Ti, $TiO_2$, Ta, $Ta_2O_5$, or $Ta_3N_5$. Examples of a method of producing the lower electrode 31 and the upper electrode 33 include a sputtering method and a vacuum deposition such as vacuum evaporation. The film thickness of the lower electrode 31 and the upper electrode 33 are preferably in a range of from 0.05 μm to 1 μm, and more preferably in a range of from 0.1 μm to 0.5 μm.

Further, an oxide electrode film formed of $SrRuO_3$ or $LaNiO_3$ as a material may be formed between the above-described metal material and the electromechanical transducer film 32 in the lower electrode 31 and the upper electrode 33. Note that the oxide electrode film between the lower electrode 31 and the electromechanical transducer film 32 also affects an orientation control of the electromechanical transducer film 32 (PZT film, for example) to be formed on the oxide electrode film. Thus, the materials selected for the oxide electrode film is different depend on the orientation to be prioritized.

For example, a seed layer of $LaNiO_3$, $TiO_2$, $PbTiO_3$ is preferably formed on the metal material as the lower electrode 31, and then the PZT film is formed on the lower electrode 31 when a piezoelectric body such as PZT is used as the electromechanical transducer film 32 and is preferentially oriented to PZT (100) in the head 2.

SrRuOx (SRO) film may be used as the oxide electrode film between the upper electrode 33 and the electromechanical transducer film 32. A film thickness of the SRO film is preferably in a range of from 20 nm to 80 nm, and more preferably in a range from 30 nm to 50 nm.

As a material of the electromechanical transducer film 32, lead zirconate titanate (PZT) can be preferably used. Note that PZT is a solid solution of lead zirconate ($PbZrO_3$) and lead titanate ($PbTiO_3$) and has different properties according to the ratio of $PbZrO_3$ and $PbTiO_3$. For example, a PZT, in which the ratio of $PbZrO_3$ and $PbTiO_3$ is 53:47, can be used, which is represented by a chemical formula of Pb ($Zr_{0.53}$, $Ti_{0.47}$) $O_3$ or generally represented as PZT (53/47).

However, when PZT(100) plane has a priority orientation using the PZT as the electromechanical transducer film 32, a composition ratio of Zr/Ti represented by Ti/(Zr+Ti) is preferably 0.45 or more and 0.55 or less, and more preferably 0.48 or more and 0.52 or less.

The crystal orientation is expressed by $\rho$ (hkl)=I (hkl)/$\Sigma$I (hkl). Here, $\rho$ (hkl) is the degree of orientation of (hkl) plane orientation, I (hkl) is peak intensity of arbitrary orientation, and $\Sigma$I (hkl) is the sum of each peak intensity. When a sum of peak intensities obtained by $\theta$-2$\theta$ measurement in an X-ray diffraction method is assumed to be 1, an orientation degree in (100) orientation calculated based on a ratio of a peak intensity in each orientation is preferably 0.75 or more, and more preferably 0.85 or more.

The electromechanical transducer film 32 may be manufactured by a sputtering method or a spin coater using sol-gel method. In such a case, a desired pattern is obtained by, for example, photolithoetching for patterning.

When the PZT used for manufacturing the electromechanical transducer film 32 is prepared by a sol-gel method, lead acetate, zirconium alkoxide, and titanium alkoxide compounds are used as starting materials. The lead acetate, the zirconium alkoxide, and the titanium alkoxide compounds are dissolved in methoxyethanol functioning as a common solvent, and a uniform solution is obtained. Thus, a PZT precursor solution is prepared. Since a metal alkoxide compound is easily hydrolyzed by atmospheric water, a stabilizer, such as acetylacetone, acetic acid, or diethanolamine may be appropriately added to the PZT precursor solution.

When the PZT film (electromechanical transducer film 32) is formed on an entire surface of the lower electrode 31, the PZT film is obtained by forming a coating by a solution coating method, such as a spin coating method, and performing each heat treatment of solvent drying, thermal decomposition, and crystallization on the coating. Transformation from the coating to a crystalline film causes volume contraction. Therefore, a concentration of the PZT precursor solution is adjusted to obtain a film thickness of 100 nm or less by one step in order to obtain a crack-free film. The film thickness of the electromechanical transducer film 32 is preferably in a range of from 1 μm to 3 μm, and more preferably in a range of from 1.5 μm to 2.5 μm.

As the electromechanical transducer film 32, an ABO 3 type perovskite type crystalline film other than PZT may be used. As the ABO 3 type perovskite type crystalline film other than PZT, for example, a lead-free complex oxide film such as barium titanate may be used. In such a case, barium alkoxide and titanium alkoxide compounds are used as a starting material and are dissolved in a common solvent, to prepare a barium titanate precursor solution.

These materials are complex oxides represented by the chemical formula $ABO_3$, where A=Pb, Ba, or Sr, B=Ti, Zr, Sn, Ni, Zn, Mg, or Nb as main components. Specific examples of the composite oxides include $(Pb_{1-x}, Ba)(Zr, Ti)O_3$ and $(Pb_{1-x}, Sr)(Zr, Ti)O_3$, in which a part of Pb at A site is replaced with Ba or Sr. The substitution is enabled in a bivalent element and an effect of the substitution is to decrease characteristic deterioration by the evaporation of the lead during the heat treatment.

As a material of the insulating protective film 40, a dense inorganic material is preferable because it is necessary to select a material that is impermeable to moisture in the atmosphere and prevents damages to the piezoelectric element (electromechanical transducer element 30) in a film formation process and etching process.

As the first insulating protective film 40, an oxide, nitride, or carbonized film may be used to obtain a high degree of protection performance with a thin film. However, it is necessary to select a material having high adhesion with the electrode material, the piezoelectric material, and the diaphragm material that serve as the base of the insulating protective film 40. In addition, it is necessary to select a film forming method that does not damage the piezoelectric element (electromechanical transducer element 30). That is, it is not preferable to use a plasma CVD (chemical vapor deposition) method in which a reactive gas is converted into a plasma and deposited on a substrate, or a sputtering method in which a film is formed by causing plasma to collide with a target material and to blow off atoms in the target material. As a preferable film formation method, vapor deposition method, ALD (Atomic Layer Deposition) method can be used. However, the ALD method having a wide choice of materials that can be used is preferable. Examples of preferable material for the insulating protective film 40 include an oxide film used for ceramic materials, such as $A1_2O_3$, $ZrO_2$, $Y_2O_3$, $Ta_2O_3$, and $TiO_2$. In particular, according to the ALD method, a thin film with quite high film density is produced, thus reducing damage to the electromechanical transducer element 30 during manufacturing process.

The insulating protective film 40 has a thickness that is large enough to obtain a protection performance of the electromechanical transducer element 30 and is small enough not to hamper the displacement of the diaphragm 20. The film thickness of the insulating protective film 40 is preferably in the range from 20 nm to 100 nm.

The insulating protective film 40 may have two layer configuration that includes insulating protective films 40*a* and 40*b* as illustrated in FIG. 4A. In this case, in order to increase the thickness of the second layer of the insulating protective film 40*b*, the second layer insulating protective film 40*b* may include an opening so that the second layer of the insulating protective film 40*b* does not significantly hamper a vibration displacement of the diaphragm 20. As the second layer of the insulating protective film 40*b*, any oxide, nitride, and carbide or a composite compound thereof can be used.

For example, $SiO_2$, which is typically used in a semiconductor device, may be used. Any suitable method may be used for forming the film such as the CVD method or sputtering, for example. In particular, considering about coating a step portion of a pattern forming part, such as an electrode forming part, the CVD method capable of isotropically forming a film is preferably used. The film thickness of the second layer of the insulating protective film 40*b* has to be set to the thickness in which the second layer of the insulating protective film 40*b* is not dielectrically broken down by a voltage applied to the lower electrode 31 and the wirings 60.

That is, the electric field intensity applied to the insulating protective film 40 has to be set in a range in which the insulating protective film 40 is not dielectrically broken down. Consideration about a surface properties or pin holes of the base of the second layer of the insulating protective film 40*b*, the film thickness is preferably equal to 200 nm or more, and more preferably 500 nm or more.

The insulating protective film 70 functions as a passivation layer having a function of a protective layer of the wiring 60. As illustrated in FIGS. 4A and 4B, the upper electrode 33 and the lower electrode 31 are covered except for the locations of the electrode pads 61 and 62 (opening 70*x*). Thus, low cost Al or an alloy material including Al as main ingredient can be used for the material of the upper electrode 33 and the lower electrode 31. As a result, the head 2 can be manufactured with low cost and high reliability.

As a material of the insulating protective film 70, any inorganic material or any organic material can be used. However, a material with low moisture permeability is preferable. Examples of inorganic material include oxide, nitride, and carbide. Examples of organic material include polyimide, acrylic resin, and urethane resin. However, the organic material is not suitable because the thickness of the insulating protective film 70 has to be increased. Accordingly, the inorganic material is preferably used because the inorganic material can exhibit a function of protecting the wiring in a thin film. In particular, it is preferable to use $Si_3N_4$ on the Al wiring because using $Si_3N_4$ on the Al wiring is technologically proved in semiconductor devices.

The film thickness of the insulating protective film 70 is preferably 200 nm or more, and more preferably 500 nm or more.

Further, the electromechanical transducer element 30 and the diaphragm 20 around the electromechanical transducer element 30 preferably include an opening. This is similar to thinning the individual chamber area of the insulating protective film 40. Thus, the head 2 that can efficiently and reliability discharge liquid is obtained.

The openings are formed by, for example, a photolithography method or dry etching because the electromechanical transducer element 30 is protected by the insulating protective film 40 and 70. Further, each area of the electrode pads 61 and 62 is preferably 50×50 $\mu m_2$ or more, more preferably 100×300 $\mu m^2$ or more.

The material of the wiring 60 is preferably a metal electrode material composed of any one of an Ag alloy, Cu, Al, Au, Pt, and Ir. As a manufacturing method of the wiring 60, a sputtering method or a spin coating method is used. Then, a desired pattern is obtained by photolithography, for example. The film thickness is preferably in a range of from 0.1 μm to 20 μm, and more preferably in a range of from 0.2 μm to 10 μm.

In addition, the contact resistance at the contact hole portion (for example, 10 μm×10 μm) is preferably 10Ω or less for the lower electrode 31 and 1Ω or less for the upper electrode 33, more preferably 5Ω or less for the lower electrode 31, and 0.5Ω or less for the upper electrode 33.

[Liquid Discharge Head Including Escape Groove]

It is known to provide an escape grooves in the head 2 on an end side of the head 2 in the arrangement direction of the pressure chambers 10X. The arrangement direction of the pressure chambers 10X is parallel to the nozzle array direction (NAD) in FIG. 3. The escape grooves guides the adhesive to prevent the adhesive from flowing into a liquid channel in the head 2 at the time of joining the substrates for manufacturing the head 2. The "escape grooves" are also simply referred to as "grooves".

It was found that variation in an amount of displacement occurs at the end portion side of the drive channels 3 by providing the escape grooves on the end side of the head 2. Thus, means for suppressing the variation in the amount of displacement of the drive channel 3 becomes necessary.

Figure 7:
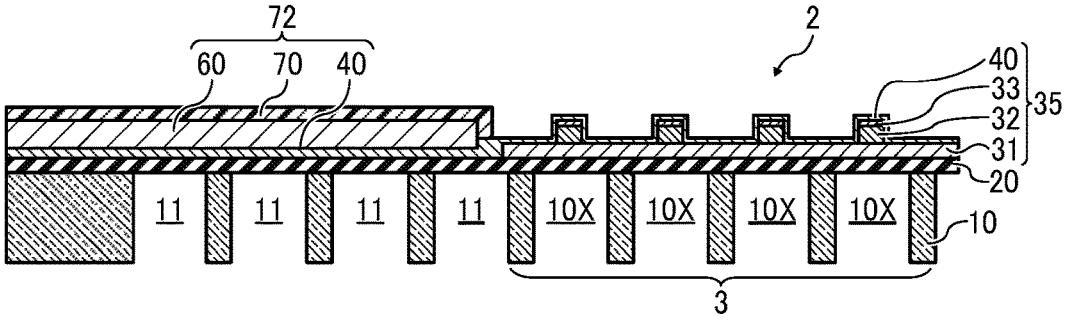
FIG. 7 is a cross sectional view of the liquid discharge head that includes escape grooves.

FIG. 7 is a cross sectional view of the head 2 that includes the escape grooves 11. The head 2 as illustrated in FIG. 7 includes escape grooves 11 on the end side in the arrangement direction of the pressure chambers 10X. The escape grooves 11 are formed by etching the substrate 10 from the direction in which the nozzle 51 is formed, that is similar to a direction from which the pressure chambers 10X is formed. The escape grooves 11 are a through groove penetrating the substrate 10 in a thickness direction of the substrate 10. Portions of the diaphragm 20 facing the pressure chamber 10X and the escape grooves 11 are exposed. In FIG. 7, four escape grooves 11 are formed on one end side in the arrangement direction of the pressure chambers 10X. The groove 11 includes an opening that opens toward a direction opposite to the diaphragm 20.

However, the number of the escape grooves 11 is not limited to four but any desired number. Further, in FIG. 7, the escape grooves 11 are formed at one end side of the head 2 in the arrangement direction of the pressure chambers 10X. However, the escape grooves 11 are also formed at another end side of the head 2. Thus, the another side of the head 2 has a same configuration with the one side of the head 2.

At a position where the escape groove 11 is formed, the diaphragm 20 forms a part of the wall of the escape groove 11. Further, the electromechanical transducer element 30 is not formed on the diaphragm 20 at the position where the escape groove 11 is formed. Further, the insulating protective film 40, a plurality of the wirings 60, and the insulating protective film 70 are formed on the diaphragm 20 in this order at the position where the escape groove 11 is formed. The wiring 60 is a wiring layer for supplying a driving signal and driving power to the electromechanical transducer element 30. The wiring 60 and the insulating protective films 40 and 70 constitute a wiring portion 72.

The wiring 60 is formed on a first side of the diaphragm 20 opposite a second side of the diaphragm 20 facing the groove 11 (escape groove).

Figure 8:
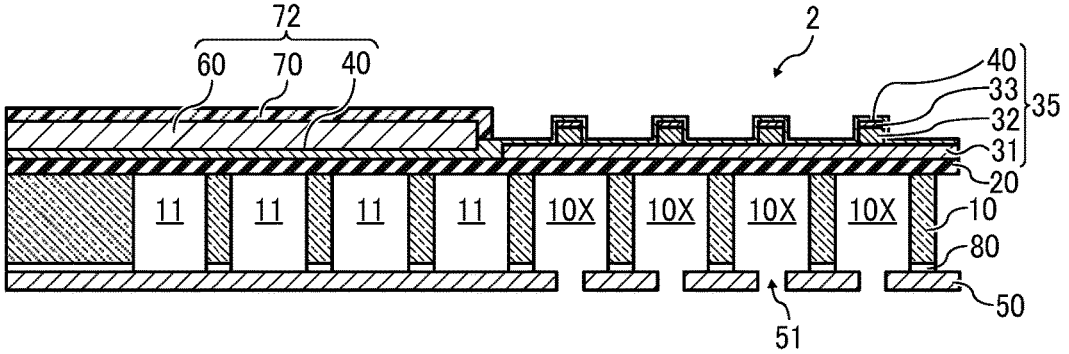
FIG. 8 is a cross sectional view of the liquid discharge head that includes escape grooves and a nozzle plate.

Then, the nozzle plate 50 including the nozzles 51 is bonded to the lower surface of the substrate 10 with the adhesive 80. FIG. 8 is a cross sectional view of the head 2. FIG. 8 illustrates the head 2 formed by bonding the nozzle plate 50 to the head 2 in FIG. 7. The nozzle 51 is formed at a position corresponding to the pressure chamber 10X as illustrated in FIG. 8. Conversely, the nozzle 51 is not formed at a position corresponding to the escape grooves 11.

A degree of deflection including a shape (radius of curvature) of deflection and an amount of deflection of the diaphragm 20 of the head 2 including the escape groove 11 as illustrated in FIG. 7 is examined. Then, it is found that a deflection of the diaphragm 20 on the escape grooves 11 influences the deflection of the diaphragm 20 of the pressure chambers 10X at each ends of the head 2 close to the escape grooves 11. The electromechanical transducer elements 30 is formed on the diaphragm 20 on which the pressure chamber 10X is formed.

Figure 9A:
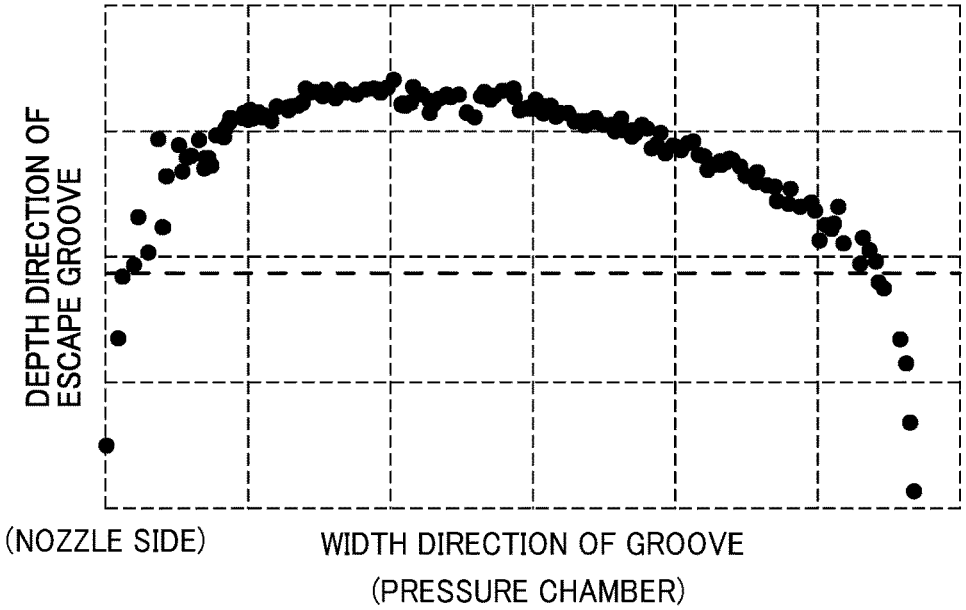
FIGS. 9A and 9B are graphs illustrating a relation between a width of the diaphragm and an amount of displacement of the diaphragm.
Figure 9B:
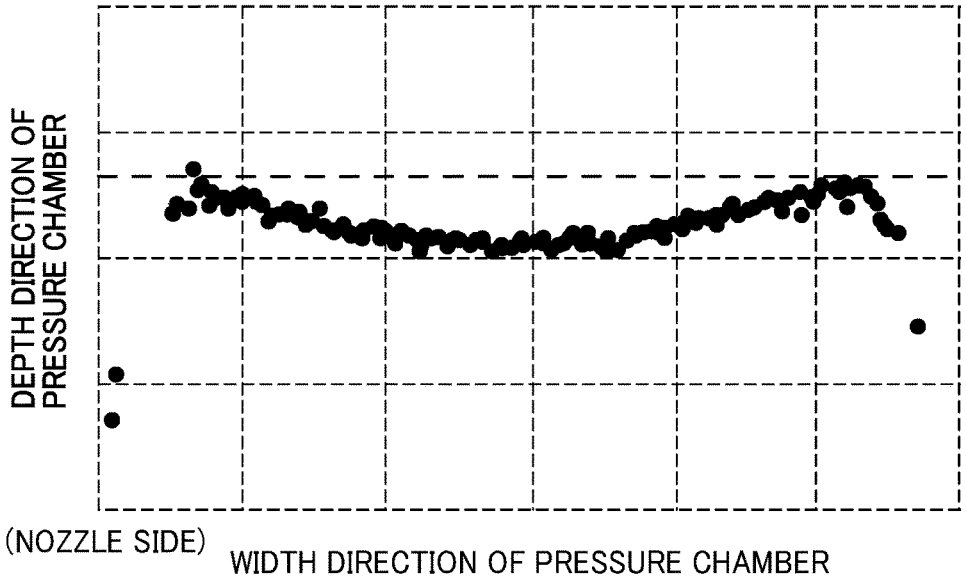

FIGS. 9A and 9B are graphs illustrating a relation between a width of the diaphragm 20 and an amount of displacement of the diaphragm 20 at each channel at positions of the escape grooves 11 and positions of the drive channels 3. FIG. 9A illustrates a relation between a width of the diaphragm 20 and an amount of displacement of the diaphragm 20 at each channel at positions of the escape grooves 11. FIG. 9B illustrates a relation between a width of the diaphragm 20 and an amount of displacement of the diaphragm 20 at each channel at positions of the pressure chambers 10X (drive channels 3). Here, a broken line in FIGS. 9A and 9B indicates a position of the diaphragm 20 when the diaphragm 20 is not deformed. As illustrated in FIG. 9A, the diaphragm 20 at the position of the escape grooves 11 is deformed in a direction in which a center portion of the diaphragm 20 is convex upward (in a direction opposite to the escape groove 11) due to a difference in a layer configuration on the diaphragm 20. Here, lower side in FIGS. 9A and 9B is a side toward the nozzles 51 (nozzle side). Conversely, as illustrated in FIG. 9B, the diaphragm 20 at the position of the pressure chambers 10X (drive channels 3) is deformed in a direction in which a center portion of the diaphragm 20 is convex downward (in a direction toward the pressure chamber 10X, or nozzle side). In this manner, the direction of the deflection of the diaphragm 20 at the positions of the escape grooves 11 is opposite to the direction of the deflection of the diaphragm 20 at the positions of the pressure chambers 10X (drive channels 3). For example, the diaphragm 20 in FIG. 9A (at escape grooves 11) deforms upward and the diaphragm 20 in FIG. 9B (at pressure chambers 10X) deforms downward.

Figure 10:
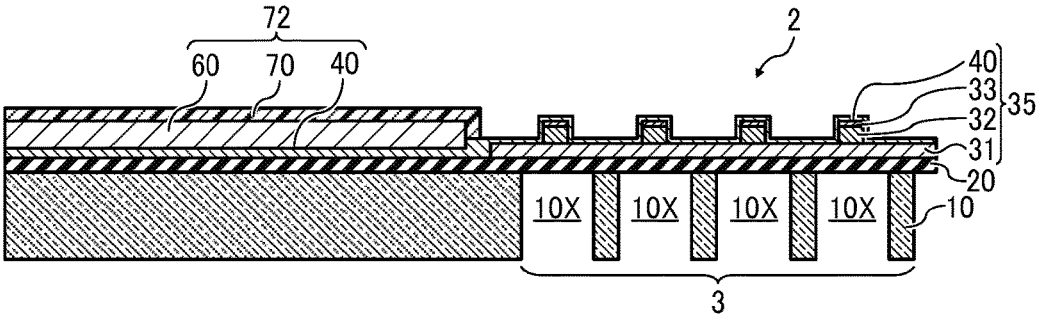
FIG. 10 is a cross-sectional view of the liquid discharge head that does not include escape grooves.

FIG. 10 is a cross-sectional view of the head 2 having the same configuration as FIG. 7 except that the escape groove 11 is formed in the head 2 of FIG. 10. For comparison purpose, the degree of deflection of the diaphragm 20 is examined for the head 2 having the same configuration as in FIG. 7, except that the escape groove 11 is not formed in the head 2 of FIG. 10.

Figure 11:
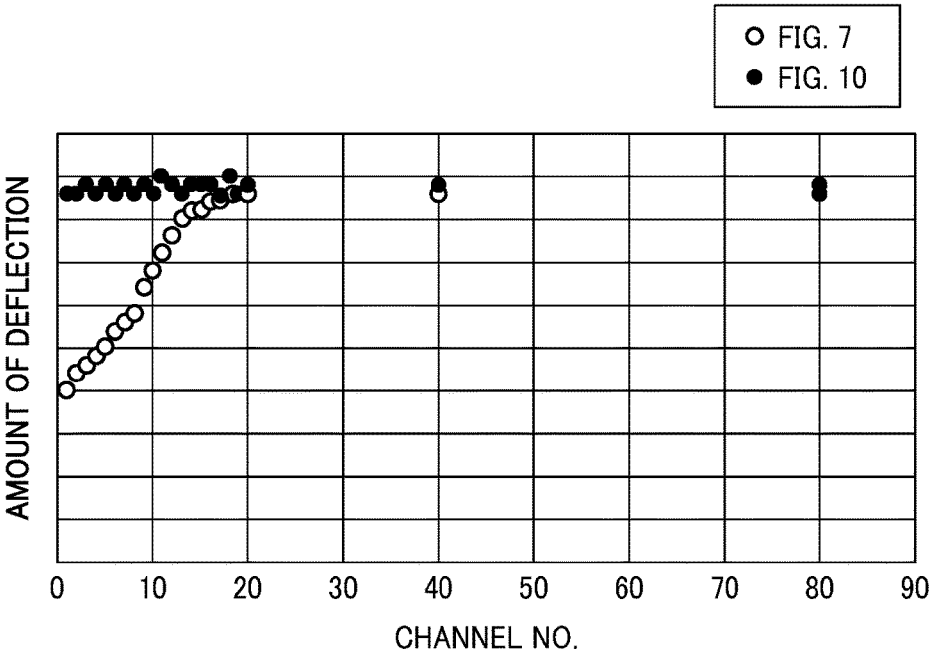
FIG. 11 is a graph illustrating the amount of deflection of the diaphragm of the liquid discharge head in FIGS. 7 and 10.

FIG. 11 is a graph illustrating the amount of deflection of the diaphragm 20 of the head 2 that includes the escape grooves 11 as illustrated in FIG. 7 and the head 2 that does not include the escape grooves 11 as illustrated in FIG. 10. In FIG. 11, the amount of the deflection of the diaphragm 20 from an end (first channel) of the drive channels 3 to the twentieth (20th) channel is illustrated. Further, the amount of the deflection of the diaphragm 20 at the fortieth (40th) channel and the eightieth (80th) channel is illustrated.

According to FIG. 11, the amount of deflection of the diaphragm 20 at the end side (left end in FIG. 11) of the drive channels 3 becomes small in the head 2 that includes the escape grooves 11 as illustrated in FIG. 7. Further, as illustrated in FIG. 11, there is a difference between the amount of deflection of the diaphragm 20 of the end side of the drive channels 3 and the amount of deflection of the diaphragm 20 of the center side of the drive channels 3 in the head 7 as illustrated in FIG. 7.

In the head 2 as illustrated in FIG. 10, the difference between the amount of deflection of the diaphragm 20 on the end side of the drive channels 3 and the amount of deflection of the diaphragm 20 of the center side of the drive channels 3 is very small to close to none. The diaphragm 20 on the end side of the drive channels 3 is closed to the escape grooves 11. The diaphragm 20 on the center side of the drive channels 3 is away from the escape grooves 11. Thus, the head 2 illustrated in FIG. 10 does not influenced by the difference in the film configuration on the diaphragm 20.

According to the above-described examination, it is known that there is difference between the amount of deflection of the diaphragm 20 of the end side of the drive channels 3 close to the escape groove 11 and the amount of deflection of the diaphragm 20 on the center side of the drive channels 3 away from the escape grooves 11. Thus, formation of the escape grooves 11 influences the amount of deflection of the diaphragm 20 between the drive channels 3. The amount of deflection of the diaphragm 20 on the end side of the drive channel 3 close to the escape grooves 11 changes by a stress from the diaphragm 20 at the position of the escape grooves 11. Thus, variation in the amount of deflection of the diaphragm 20 between the drive channels 3 of the head 2 influences a discharge performance of the head 2.

Conversely, if the layer configuration of the wiring portion 72 on the diaphragm 20 at the escape grooves 11 is made identical to the layer configuration of the diaphragm 20 at the drive channels 3, the influence of the stress from the diaphragm 20 at the position of the escape grooves 11 can be reduced. Thus, the variation in the amount of deflection between the drive channels 3 can be suppressed.

However, when considering the wiring resistance, for example, it is difficult to make all the layer configuration of the diaphragm 20 at the escape grooves 11 to be identical to the layer configuration of the diaphragm 20 at the drive channels 3 in the arrangement direction of the pressure chamber 10X in the head 2. Thus, as illustrated in FIG. 7, it is necessary to form the wiring 60 without forming the electromechanical transducer film 32 in the structure located outside the end side of the drive channels 3 in order to lower the wiring resistance.

Thus, the head 2 (liquid discharge head) according to the present embodiment includes the substrate 10 (pressure chamber substrate), the diaphragm 20, and the electromechanical transducer element 30. The pressure chambers 10X are arranged in a predetermined direction in the substrate 10.

The pressure chambers 10X communicates with the nozzles 51, respectively, for discharging liquid from the nozzles 51. The diaphragm 20 is provided opposite to the nozzle 51 side in the substrate 10. A part of the diaphragm 20 constitutes a wall of the pressure chamber 10X. The electromechanical transducer elements 30 are provided on the diaphragm 20 corresponding to pressure chambers 10X, respectively. The escape grooves 11 are formed in the substrate 10 on an end side of the head 2 in the predetermined direction (the arrangement direction of the pressure chambers 10X or nozzle array direction (NAD)).

The escape groove 11 (groove) includes an opening in a surface facing the nozzle 51. The escape groove 11 introduces an excessive adhesive when the substrate (pressure chamber substrate) 10 is joined with other substrates. The diaphragm 20 at the pressure chambers 10X (drive channels 3) is formed to be displaced in a direction toward the pressure chamber 10X (downward in FIG. 8) for each of the pressure chambers 10X. The diaphragm 20 at the escape grooves 11 (grooves) is formed to be displaced in a direction opposite to the opening of the escape grooves 11 (upward in FIG. 8) for each of the escape grooves 11. The amount of deflection of the diaphragm 20 at each pressure chambers 10X is larger than the amount of deflection of the diaphragm 20 at each escape grooves 11 (grooves). Here, the description in parentheses indicates reference numerals and application examples in the embodiments.

As illustrated in FIG. 5, the diaphragm 20 at the pressure chambers 10X (drive channels 3) is displaced to be convex toward the pressure chamber 10X (downward in FIG. 5) in the manufacturing process of the head 2. That is, the diaphragm 20 on the pressure chamber 10X deflects (curved) to convex toward the pressure chamber 10X (downward in FIG. 5).

On the other hand, as described above, the wiring 60 and the insulating protective films 40 and 70 are formed on the diaphragm 20 over the escape grooves 11. The electromechanical transducer elements 30 are not formed on the diaphragm 20 over the escape grooves 11. Thus, the diaphragm 20 on the escape grooves 11 deflects to be convex in a direction opposite to the escape groove 11 since the electromechanical transducer element 30 having a strong tensile stress is not formed on the diaphragm 20 on the escape grooves 11. Thus, the diaphragm 20 on the escape groove 11 is deflects (curved) to be convex in a direction opposite to the escape groove 11 (upward in FIG. 7).

However, difference in the deflection direction of the diaphragm 20 on the pressure chamber 10X and the deflection direction of the diaphragm 20 on the escape grooves 11 influences the deflection of the diaphragm 20 of the pressure chambers 10X (drive channels 3).

Thus, the head 2 according to the present disclosure adjusts the degree of deflection (deflection degree) of the diaphragm 20 on the escape groove 11 by controlling the layer configuration of the wiring portion 72 on the diaphragm 20 at the escape grooves 11. As a control of the layer configuration of the wiring portion 72, at least one of a thickness and material of the wiring 60 and a thickness and material of the insulating protective films 40 and 70 is adjusted. Thus, the deflection degree of the diaphragm 20 on the escape grooves 11 is set to be sufficiently smaller than the deflection degree of the diaphragm 20 on the drive channels 3.

Further, the degree of deflection of the diaphragm 20 of the pressure chambers 10X (drive channels 3) is adjusted (increased) by controlling a physical properties of the film to increase the tensile stress of the electromechanical transducer element 30 The degree of deflection of the diaphragm 20 of the drive channels 3 may be made larger than the degree of deflection of the diaphragm 20 on the escape grooves 11.

In this way, the degree of deflection of the diaphragm 20 on the drive channels 3 can be made larger than the degree of deflection of the diaphragm 20 on the escape grooves 11 by controlling the layer configuration of the wiring portion 72 on the diaphragm 20 at the escape grooves 11 and the layer configuration on the diaphragm 20 at the drive channels 3 (pressure chambers 10X).

As described above, the head 2 according to the present disclosure reduces the influence on the diaphragm 20 of the drive channels 3 by making the deflection degree of the diaphragm 20 of the drive channels 3 to be larger than the deflection degree of the diaphragm 20 of the escape grooves 11. Thus, the head 2 according to the present disclosure can suppress the influence of the escape grooves 11 on the deflection of the diaphragm 20 of the drive channels 3 (pressure chambers 10X) in the end side of the head 2 that is close to the escape grooves 11 even when the head 2 includes the escape grooves 11. Thus, the head 2 can suppress the variation of the amount of deflection of the diaphragm 20 between drive channels 3. The variation is caused by the difference of the deflection direction of the diaphragm 20 at the escape grooves 11 and the deflection direction of the diaphragm 20 at the drive channels 3 that is opposite to the deflection direction of the diaphragm 20 at the escape grooves 11.

Next, an evaluation method of the degree of deflection (deflection degree) is described below. The degree of deflection can be evaluated, for example, by using the radius of curvature R of the diaphragm 20. The radius of curvature R may be, for example, calculated by the calculation method described with reference to FIG. 6.

Figure 12A:
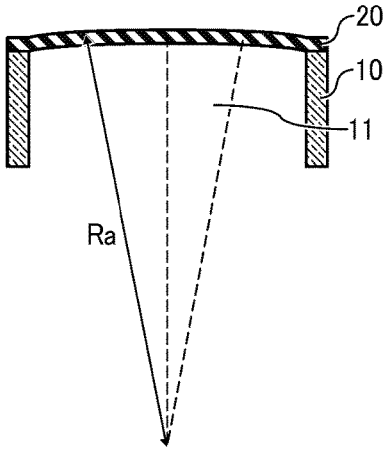
FIGS. 12A and 12B are cross-sectional views of the diaphragm illustrating a radius of curvature of the diaphragm.
Figure 12B:
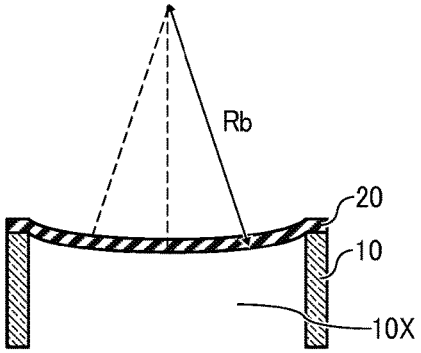

FIG. 12A is a cross sectional view of the diaphragm 20 at the position of the escape groove 11 illustrating a radius of curvature of the diaphragm 20. FIG. 12B is a cross-sectional view of the diaphragm 20 at the position of the drive channel 3 illustrating a radius of curvature of the diaphragm 20. The layer configuration on the diaphragm 20 is omitted in FIGS. 12A and 12B because of simplicity. As illustrated in FIGS. 12A and 12B, a relation of Ra>Rb is satisfied where Ra is a radius of curvature of the diaphragm 20 at the escape groove 11, and Rb is a radius of curvature of the diaphragm 20 at the drive channel 3.

Figure 13A:
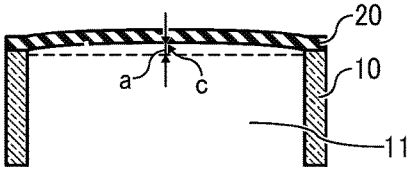
FIGS. 13A and 13B are cross-sectional views of the diaphragm illustrating a radius of curvature of the diaphragm.
Figure 13B:
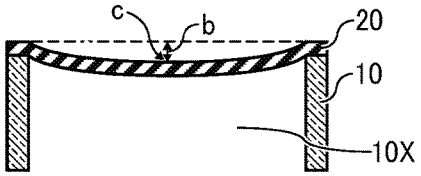

Further, the degree of deflection can be evaluated using the deflection amount of the diaphragm 20. FIG. 13A is a cross sectional view of the diaphragm 20 at the position of the escape groove 11 illustrating an amount of deflection of the diaphragm 20. FIG. 13B is a cross-sectional view of the diaphragm 20 at the drive channel 3 illustrating an amount of deflection of the diaphragm 20.

In this case, as illustrated in FIGS. 13A and 13B, an amount of deflection of the diaphragm 20 is defined as described below. First, a line perpendicular to a line (broken line in FIGS. 13A and 13B) of a formation position of the diaphragm 20 when there is no deflection in the diaphragm 20 is defined. Then, the amount of deflection of the diaphragm 20 is defined by a distance between a center point C of the deflection of the diaphragm 20 and the formation position (broken line in FIGS. 13A and 13B) of the diaphragm 20 when there is no deflection in the diaphragm 20. As illustrated in FIGS. 13A and 13B, a relation of a>b is satisfied where "a" is an amount of deflection of the diaphragm 20 at the escape groove 11, and "b" is an amount of deflection of the diaphragm 20 at the drive channel 3.

The examples described-above define a relation between the deflection degree of the diaphragm 20 at the escape groove 11 and the deflection degree of the diaphragm 20 at the drive channels 3. However, it is not necessary to define the relation between the amount of deflection of the diaphragm 20 at the escape groove 11 and the amount of deflection of the diaphragm 20 at the drive channel 3. For example, the radius of the curvature of the deflection of the diaphragm 20 at the escape groove 11 may be sufficiently made large. Thus, the head 2 can suppress the variation of the deflection amount of the diaphragm 20 between groups of drive channels 3. The variation is caused by the difference of the deflection direction of the diaphragm 20 at the escape grooves 11 and the deflection direction of the diaphragm 20 at the drive channels 3 that is opposite to the deflection direction of the diaphragm 20 at the escape grooves 11.

The radius of curvature R of the diaphragm 20 at the escape groove 11 is preferably 5000 μm or more, and more preferably 7000 μm or more.

Thus, the diaphragm 20 at the plurality of pressure chambers 10X is formed to be deflexed toward the plurality of pressure chambers 10X, the diaphragm 20 at the groove 11 (escape groove) is formed to be deflexed opposite to the opening of the groove 11, and a degree of deflection of the diaphragm 20 at the plurality of pressure chambers 10X is larger than a degree of deflection of the diaphragm 20 at the groove 11.

Each of the degree of deflection of the diaphragm 20 at the plurality of pressure chambers 10X and the degree of deflection of the diaphragm 20 at the groove 11 is determined by a radius of curvature R. The radius of curvature Ra of the diaphragm 20 at the groove 11 is larger than a radius of curvature Rb of the diaphragm 20 at the plurality of pressure chambers 10X.

The degree of deflection of the diaphragm 20 is determined by an amount of deflection of the diaphragm 20, and an amount of deflection of the diaphragm 20 at the groove 11 is smaller than an amount of deflection of the diaphragm 20 at the plurality of the pressure chambers 10X.

Figure 14A:
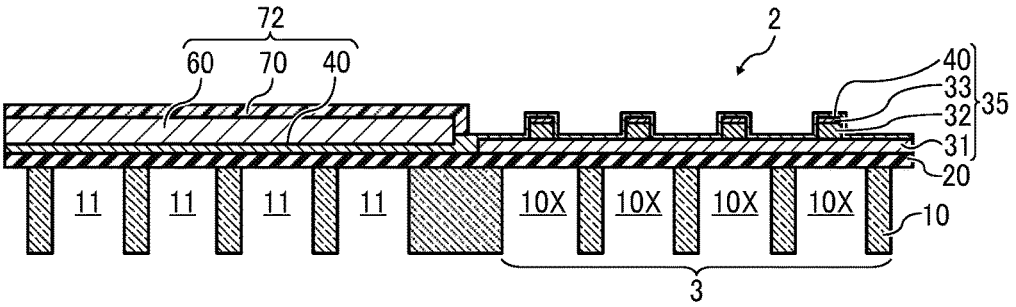
FIGS. 14A and 14B are a cross-sectional view and a plan view of the liquid discharge head that includes escape grooves.
Figure 14B:
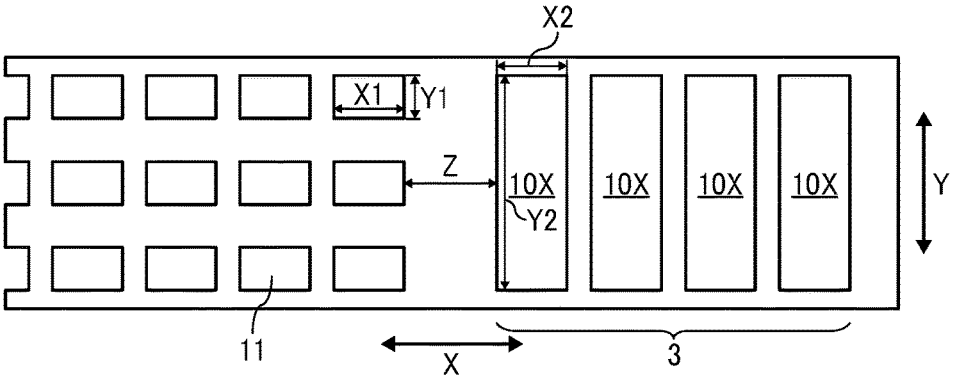

Next, a size of the escape grooves 11 and a forming position of the escape grooves 11 are described below. FIG. 14A is a cross-sectional view of the head 2 in the arrangement direction of the pressure chambers 10X (in the nozzle array direction, NAD). The head 2 in FIG. 14A is in a state where the nozzle plate 50 is not joined to the substrate 10. FIG. 14B is a plan view of the head 2 seen from the nozzle plate 50 side. The layer configuration of the head 2 as illustrated in FIGS. 14A and 14B is the same with the layer configuration of the head 2 as illustrated in FIG. 7. As illustrated in FIG. 14B, intervals of the escape grooves 11 satisfy a predetermined relation. Further, a distance Z between the endmost drive channel 3 (the endmost pressure chamber 10X) and the escape groove 11 satisfies a predetermined relation.

As illustrated in FIG. 14B, the arrangement direction of the pressure chambers 10X (a short-side direction of the pressure chamber) is defined as a X-direction, and the direction perpendicular to X-direction (a longitudinal direction of the pressure chamber) is defined as a Y-direction. The following equation (1) is preferably satisfied when it is assumed that the size of the escape groove 11 in the X-direction is X1, the size of the escape groove 11 in the Y-direction is Y1, the size of the pressure chamber 10X in the X-direction is X2, and the size of the pressure chamber 10X in the Y-direction is Y2.

$$X1 \leq X2 \text{ and } Y1 < Y2 \quad (1)$$

In this way, the influence of stress can be preferably reduced by making the size of the escape groove 11 to be smaller than the size of the pressure chamber 10X. Here, the size of the escape groove 11 and the pressure chamber 10X may be the same in the X-direction (X1=X2).

The size of the escape groove 11 is preferably 100 μm or less for both of X1 and Y1, and more preferably 50 μm.

Further, the arrangement interval of the escape grooves 11 is preferably 30 μm or more in the X-direction, and is 30 μm or more in the Y-direction, more preferably 100 μm or more.

The distance Z between the endmost drive channel 3 (the endmost pressure chamber 10X) and the escape groove 11 is preferably 100 μm or more, more preferably 200 μm.

In this way, the head 2 can reduce the influence of the stress on the endmost drive channel 3 and reduce variations in discharge performance between the drive channels 3 by forming the size and the forming position of the escape groove 11 to satisfy the predetermined relation as described above.

The head 2 according to the present disclosure can suppress the variation in the deflection degree of the diaphragm 20 between the drive channels 3 in a configuration including the escape groove 11. Thus, the head 2 has a good discharge performance.

The head 2 according to the present disclosure is not limited to the configuration as illustrated in FIGS. 7 and 14. The head 2 according to the present disclosure is also applied to other various types of the heads having a configuration corresponding to the escape groove for guiding excessive adhesive.

Second Embodiment

The head 2 according to a second embodiment of the present disclosure is described below. Note that redundant descriptions of the same or similar components and configurations may be omitted below.

Figure 15:
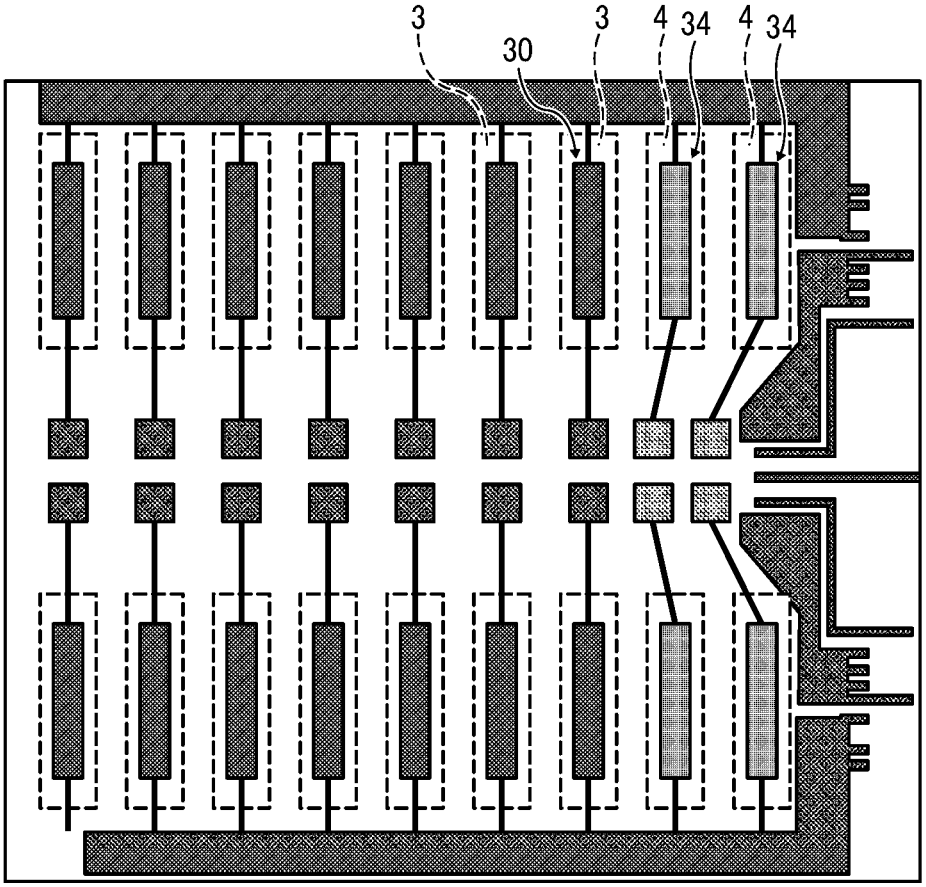
FIG. 15 is a plan view of the liquid discharge head.

As illustrated in FIG. 15, the head 2 includes dummy channels 4 that respectively include dummy electromechanical transducer elements 34 on the end of the pressure chambers 10X in the arrangement direction of the electromechanical transducer elements 30 (drive channels 3). The dummy electromechanical transducer element 34 does not discharge liquid droplets i The dummy channel 4 discharges air bubbles during filling the liquid to the head 2 to improve the filling property of the liquid to the head 2. In the head 2 as illustrated in FIGS. 15, and 16A and 16B, a unit composed of a dummy pressure chamber 12 (see FIGS. 16A and 16B), the diaphragm 20, and the electromechanical transducer element 30 that do not discharge the liquid are referred to as a dummy channel 4.

Thus, the head 2 in the second embodiment includes the dummy channel 4 on the end side (outside) of the drive channels 3 in the arrangement direction of the pressure chambers 10X and the escape groove 11 provided on the end side (outside) of the dummy channel 4. An arrayed number of dummy channels 4 may be at least one per one end portion of the drive channels 3. However, the arrayed number of dummy channels 4 is preferably three or more per one end portion of the drive channels 3 to improve the filling property of the liquid to the head 2.

Figure 16A:
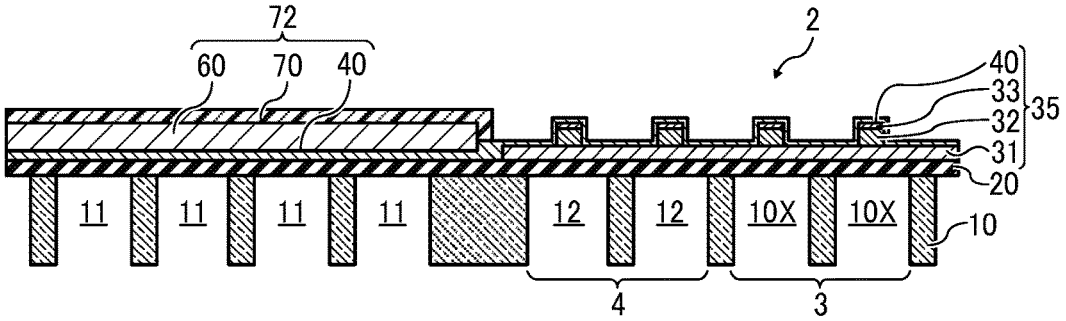
FIGS. 16A and 16B are a cross-sectional view and a plan view, respectively, of the liquid discharge head including escape grooves and dummy channels.
Figure 16B:
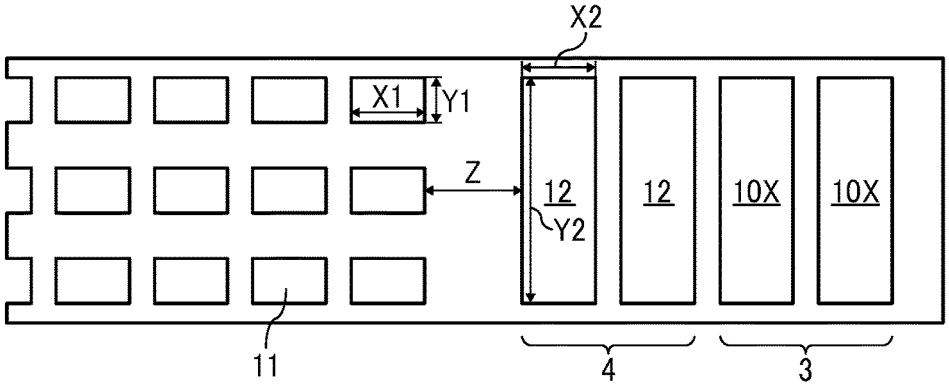

FIGS. 16A and 16B illustrate still another example of the head 2 according to a second embodiment. FIG. 16A is a cross-sectional view of the head 2 in the arrangement direction of the pressure chambers 10X (in the nozzle array direction, NAD). The head 2 in FIG. 16A is in a state where the nozzle plate 50 is not joined to the substrate 10. FIG. 16B is a plan view of the head 2 seen from the nozzle plate 50 side.

Figure 17:
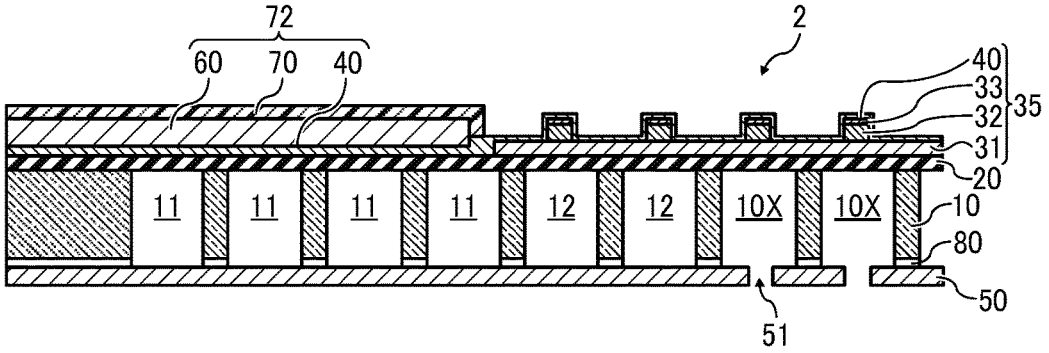
FIG. 17 is a cross-sectional view of the liquid discharge head including escape grooves and dummy channels.

FIG. 17 illustrates an example in which the nozzle plate 50 is joined to the head 2 illustrated in FIGS. 16A and 16B with the adhesive 80. As illustrated in FIG. 17, the nozzle 51 is formed at a position corresponding to the pressure chambers 10X, and the nozzle 51 is not formed at a position corresponding to the dummy pressure chambers 12 and the escape grooves 11.

Here, the configuration of the dummy pressure chamber 12 of the dummy channel 4 and the layer configuration on the diaphragm 20 of the dummy channel 4 may be the same as the configuration of the pressure chamber 10X and the layer configuration on the diaphragm 20 of the drive channel 3. Thus, the diaphragm 20 of the dummy channel 4 also deflects to be convex toward the dummy pressure chamber 12 at the time of manufacturing the dummy pressure chamber 12 in the process of manufacturing the head 2. Therefore, the diaphragm 20 is formed in a state to be convex toward the dummy pressure chamber 12.

The distance Z between the endmost dummy channel 4 (the endmost dummy pressure chamber 12) and the escape groove 11 is preferably 30 μm or more, more preferably 100 μm. The size of the escape groove 11 and the interval between the escape grooves 11 in the second embodiment as illustrated in FIGS. 16A and 16B are preferably the same as the size of the escape groove 11 and the interval between the escape grooves 11 in the first embodiment as illustrated in FIGS. 14A and 14B.

The direction of deflection of the diaphragm 20 at the escape groove 11 is opposite to the direction of deflection of the diaphragm 20 at the dummy channel 4 and the drive channel 3. This difference in the direction of the deflection affects the deflection of the diaphragm 20 of the drive channel 3.

Conversely, in the second embodiment, the layer configuration on the diaphragm 20 on the escape groove 11 or the physical properties of the film of the electromechanical transducer element 30 is controlled. Thus, the degree of deflection of the diaphragm 20 at the escape groove 11 is made smaller than the degree of deflection of the diaphragm 20 at the drive channel 3 and the dummy channel 4. Therefore, the influence of the stress from the escape groove 11 on the deflection of the diaphragm 20 of the drive channel 3 can be reduced.

According to the head 2 according to the second embodiment as described-above, it is possible to reduce the influence of the stress from the escape groove 11 on the endmost drive channel 3. Further, it is possible to suppress variations in discharge performance between the drive channels 3. Further, the dummy channel 4 is provided between the drive channel 3 and the escape groove 11 in the arrangement direction of the pressure chambers 10X. Thus, it is possible to improve the filling property of the liquid to the head 2 as compared with the configuration without the dummy channel 4 such as the first embodiment, for example.

Third Embodiment

Figure 18A:
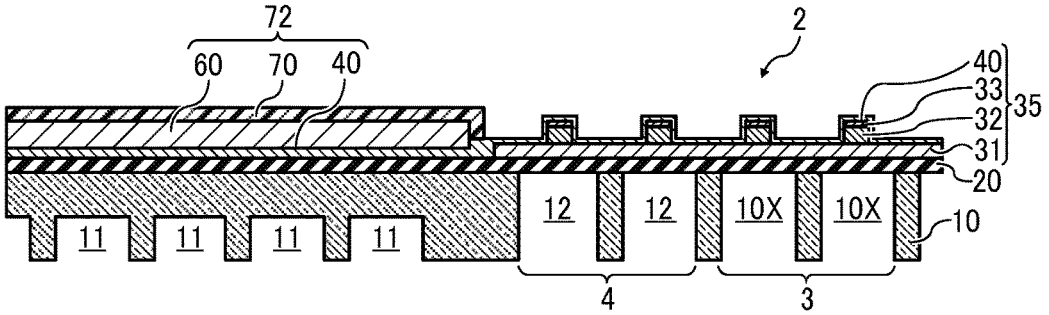
FIGS. 18A and 18B are a cross-sectional view and a plan view, respectively, of the liquid discharge head including a non-penetration type escape grooves.
Figure 18B:
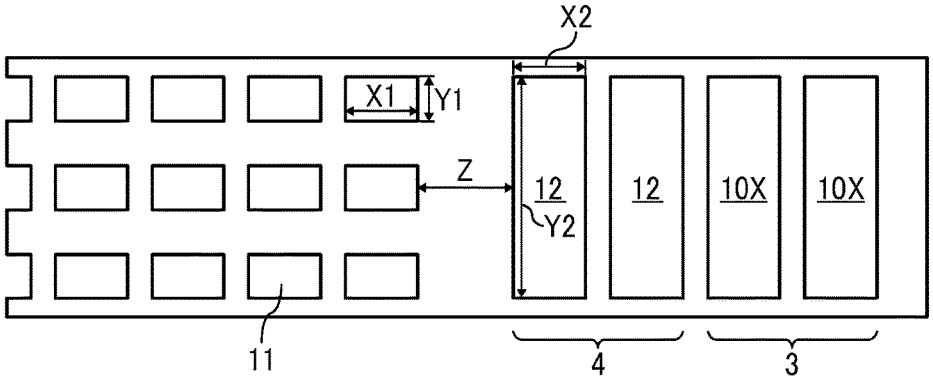

FIGS. 18A and 18B illustrate still another example of the head 2 according to a third embodiment. FIG. 18A is a cross-sectional view of the head 2 in the arrangement direction of the pressure chambers 10X (in the nozzle array direction, NAD). The head 2 in FIG. 18A is in a state where the nozzle plate 50 is not joined to the substrate 10. FIG. 18B is a plan view of the head 2 seen from the nozzle plate 50 side.

In the first and second embodiments, the escape grooves 11 penetrate the substrate 10. In the third embodiment, the escape groove 11 has a shape in which the surface of the substrate 10 on the nozzle 51 side is opened, and the escape groove 11 does not penetrate through the substrate 10.

As illustrated in FIG. 18A, a part of the substrate 10 exists between the diaphragm 20 and the escape groove 11 in the head 2 according to the third embodiment as described above, Thus, the head 2 in the third embodiment prevents the deflection of the diaphragm 20 at the escape groove 11 and reduces the influence of the stress from the escape groove 11 on the end side of the drive channel 3 close to the escape groove 11. Therefore, the head 2 of the third embodiment can reduce variations in the discharge performance between the drive channels 3.

Fourth Embodiment

Figure 19:
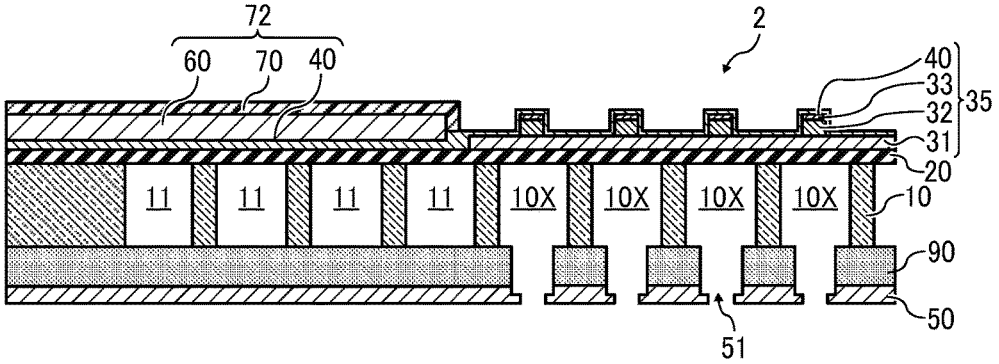
FIG. 19 is a cross sectional view of the liquid discharge head that includes escape grooves and a communication channel substrate.

FIG. 19 is a cross sectional view of the head 2 according to a fourth embodiment. The nozzle plate 50 is directly joined (bonded) to the substrate 10 in the above-described examples. However, a substrate to be joined (bonded) to the nozzle 51 side of the substrate 10 is not limited to the nozzle plate 50. For example, as illustrated in FIG. 19, a communication channel substrate 90 is joined (bonded) to the nozzle plate 50 so that the communication channel substrate 90 is disposed between the substrate 10 and the nozzle plate 50. The communication channel substrate 90 is a substrate in which a communicating channel for communicating the pressure chamber 10X with the nozzle 51 is provided.

Fifth Embodiment

The head 2 (liquid discharge head) according to the fifth embodiment includes the substrate 10 (pressure chamber substrate), the diaphragm 20, and the electromechanical transducer element 30. The pressure chambers 10X are arranged in a predetermined direction (arrangement direction of the pressure chambers 10X) in the substrate 10. The pressure chambers 10X communicates with the nozzles 51, respectively, for discharging liquid from the nozzles 51. The diaphragm 20 is provided opposite to the nozzle 51 side in the substrate 10. A part of the diaphragm 20 constitutes a wall of the pressure chamber 10X.

The electromechanical transducer elements 30 are provided on the diaphragm 20 corresponding to pressure chambers 10X, respectively. The escape grooves 11 are formed in the substrate 10 on an end side of the pressure chambers 10X in the predetermined direction (arrangement direction of the pressure chambers 10X or nozzle array direction (NAD)).

The escape groove 11 (groove) includes an opening in a surface facing the nozzle 51. The escape groove 11 guides (introduces) an excessive adhesive when the substrate 10 (pressure chamber substrate) is joined (bonded) with other substrates. The diaphragm 20 at the pressure chambers 10X (drive channels 3) is formed to be displaced in a direction toward the pressure chamber 10X (downward in FIG. 8) for each of the pressure chambers 10X. The diaphragm 20 at the escape grooves 11 (grooves) is formed to be displaced in a direction toward the openings of the escape grooves 11 (downward in FIG. 8) for each of the escape grooves 11. Here, the description in parentheses indicates reference numerals and application examples in the embodiments.

That is, the direction of deflection of the diaphragm 20 at the escape groove 11 and the direction of deflection of the diaphragm 20 at the drive channel 3 are in the same direction. The degree of deflection of the diaphragm 20 at the drive channels 3 is preferably larger than the degree of deflection of the diaphragm 20 at the escape grooves 11. The radius of curvature R of the diaphragm 20 at the escape groove 11 is preferably 2000 μm or more, and more preferably 6000 μm or more.

Thus, the head 2 according to the present disclosure adjusts the degree of deflection (deflection degree) of the diaphragm 20 on the escape groove 11 by controlling the layer configuration of the wiring portion 72 on the diaphragm 20 at the escape grooves 11. As a control of the layer configuration of the wiring portion 72, at least one of a thickness and material of the wiring 60 and a thickness and material of the insulating protective films 40 and 70 is adjusted. That is, the direction of deflection of the diaphragm 20 at the escape groove 11 is made to be convex toward the opening side of the escape groove 11. Thus, the direction of deflection of the diaphragm 20 at the escape groove and the direction of deflection of the diaphragm 20 at the drive channel 3 becomes the same. In other words, as similar to the diaphragm at the drive channels 3, a tensile stress is also applied on the diaphragm 20 at the escape grooves 11.

Thus, the degree of deflection of the diaphragm 20 at the escape grooves 11 is preferably set to be sufficiently smaller than the deflection degree of the diaphragm 20 on the drive channels 3.

For example, as described above, it is preferable to use a SiN film having a tensile stress for the insulating protective films 40 and 70. At this time, it is possible to adjust the stress state of the diaphragm 20 at the escape grooves 11 to be same as the stress state of the diaphragm 20 at the drive channels 3 by controlling the film thickness of the SiN film. If the tensile stress of the diaphragm 20 at the escape groove 11 is too large, the amount of deflection at the end side of the drive channels 3 (twenty channels from the end of the pressure chambers 10X, for example) becomes large. Thus, the variation in the degree of deflection occurs. Therefore, the tensile stress of the diaphragm 20 at the escape grooves 11 has to be appropriately adjusted.

In this way, the direction of deflection of the diaphragm 20 at the escape groove 11 and the direction of deflection of the diaphragm 20 at the drive channel 3 are formed to be the same by controlling the layer configuration of the wiring portion 72 on the diaphragm 20 at the escape grooves 11. Further, the degree of deflection of the diaphragm 20 at the drive channels 3 can be made larger than the degree of deflection of the diaphragm 20 at the escape grooves 11.

As described above, the head 2 according to the present disclosure reduces the influence of the deflection of the diaphragm 20 at the escape grooves 11 on the diaphragm 20 at the drive channels 3. Thus, the head 2 can suppress the influence of the escape grooves 11 on the deflection of the diaphragm 20 of the end side of the drive channels 3 that is close to the escape grooves 11 even when the head 2 includes the escape grooves 11. Thus, the variation in the amount of deflection of the diaphragm 20 between the drive channels 3 can be suppressed.

Next, an evaluation method of the degree of deflection (deflection degree) is described below. The degree of deflection can be evaluated, for example, by using the radius of curvature R of the diaphragm 20. The radius of curvature R is, for example, calculated by the calculation method described with reference to FIGS. 6A and 6B.

Figure 20A:
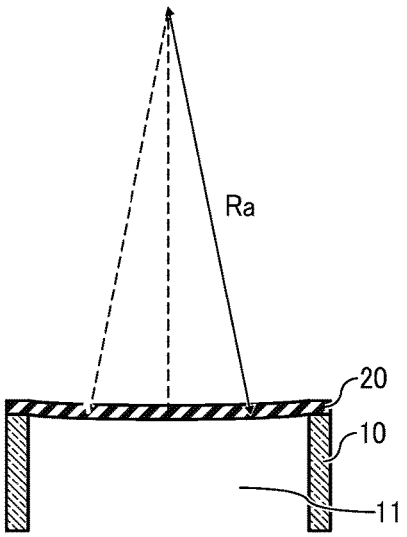
FIGS. 20A and 20B are cross sectional views of the diaphragm illustrating a radius of curvature of the diaphragm.
Figure 20B:
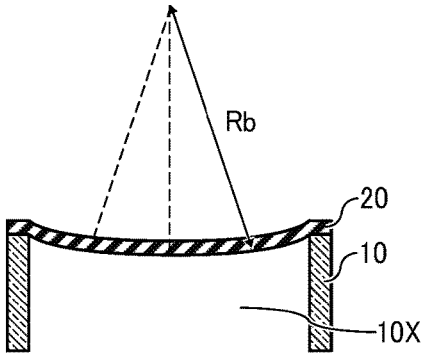

FIG. 20A is a cross sectional view of the diaphragm 20 illustrating a radius of curvature R of the diaphragm 20 at the forming position of the escape grooves 11. FIG. 20B is a cross-sectional view of the diaphragm 20 at the position of the drive channel 3 illustrating a radius of curvature of the diaphragm 20. The layer configuration on the diaphragm 20 is omitted in FIGS. 20A and 20B for simplicity. As illustrated in FIGS. 20A and 20B, a relation of Ra>Rb is satisfied where Ra is a radius of curvature of the diaphragm 20 at the escape groove 11, and Rb is a radius of curvature of the diaphragm 20 at the drive channel 3.

Figure 21A:
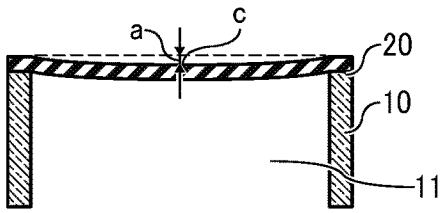
FIGS. 21A and 21B are cross sectional views of the diaphragm illustrating an amount of deflection of the diaphragm.
Figure 21B:
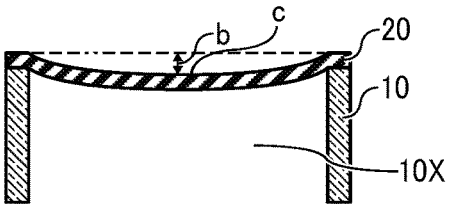

Further, the degree of deflection can be evaluated using the deflection amount of the diaphragm 20. FIG. 21A is a cross sectional view of the diaphragm 20 illustrating an amount of deflection of the diaphragm 20 at the forming position of the escape groove 11. FIG. 21B is a cross-sectional view of the diaphragm 20 at the drive channel 3 illustrating an amount of deflection of the diaphragm 20.

In this case, as illustrated in FIGS. 21A and 21B, an amount of deflection of the diaphragm 20 is defined as described below. First, a line perpendicular to a line (broken line in FIGS. 21A and 21B) of a formation position of the diaphragm 20 when there is no deflection in the diaphragm 20 is defined. Then, the amount of deflection of the diaphragm 20 is defined by a distance between a center point C of the deflection of the diaphragm 20 and the formation position (broken line in FIGS. 21A and 21B) of the diaphragm 20 when there is no deflection in the diaphragm 20. As illustrated in FIGS. 21A and 21B, a relation of a<b is satisfied where "a" is an amount of deflection of the diaphragm 20 at the escape groove 11, and "b" is an amount of deflection of the diaphragm 20 at the drive channel 3.

The examples described above define a relation between the degree of deflection of the diaphragm 20 at the escape groove 11 and the degree of deflection of the diaphragm 20 at the drive channels 3. However, it is not necessary to define the relation between the amount of deflection of the diaphragm 20 at the escape groove 11 and the amount of deflection of the diaphragm 20 at the drive channel 3. For example, the diaphragm 20 at the escape groove 11 is formed to be deflexed in a direction toward the opening of the escape groove 11. Further, the radius of the curvature R of the deflection of the diaphragm 20 at the escape groove 11 may be sufficiently made large. Thus, the variation in the amount of deflection of the diaphragm 20 between the drive channels 3 can be suppressed.

Sixth Embodiment

The head 2 according to the sixth embodiment has a same configuration with the above-described second embodiment illustrated in FIGS. 16A and 16B except that the direction of deflection of the diaphragm 20 at the escape grooves 11, the direction of deflection of the diaphragm 20 at the dummy channels 4, and the direction of deflection of the diaphragm 20 at the drive channels 3 are all made same. Thus, the degree of deflection of the diaphragm 20 at the escape groove 11 is made smaller than the degree of deflection of the diaphragm 20 at the drive channel 3 and the dummy channel 4.

The head 2 according to the sixth embodiment can suppress the influence of the stress from the escape grooves 11 by making the direction of deflection of the diaphragm 20 at the escape grooves 11, the direction of deflection of the diaphragm 20 at the dummy channels 4, and the direction of deflection of the diaphragm 20 at the drive channels 3 to be the same.

The head 2 according to the sixth embodiment can suppress the influence of the stress from the escape grooves 11 by making the degree of deflection of the diaphragm 20 at the escape grooves 11 to be smaller than the degree of deflection of the diaphragm 20 at the dummy channels 4 and the drive channels 3.

[Liquid Discharge Apparatus]

Figure 22:
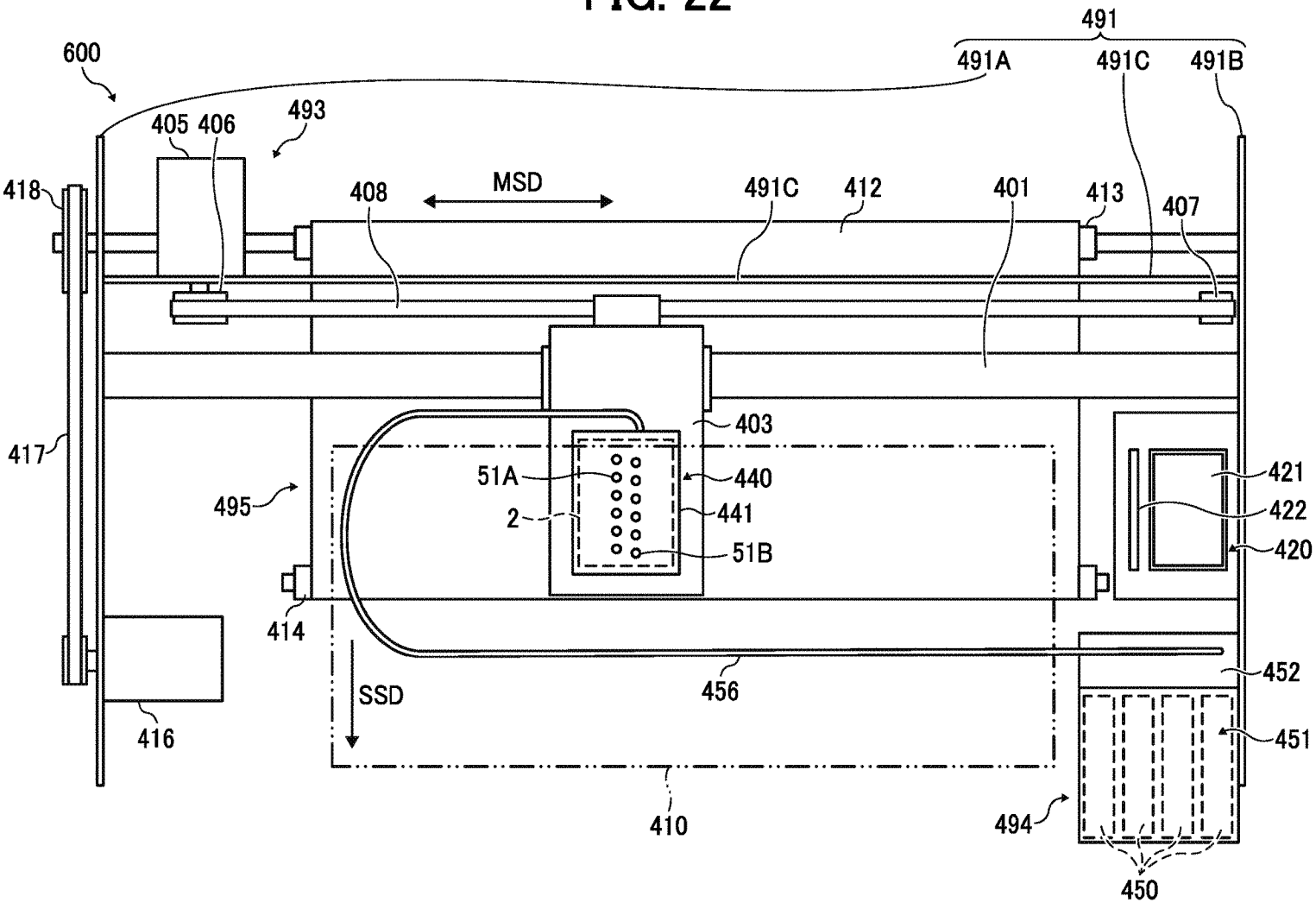
FIG. 22 is a plan view of a portion of a liquid discharge apparatus according to an embodiment of the present disclosure.
Figure 23:
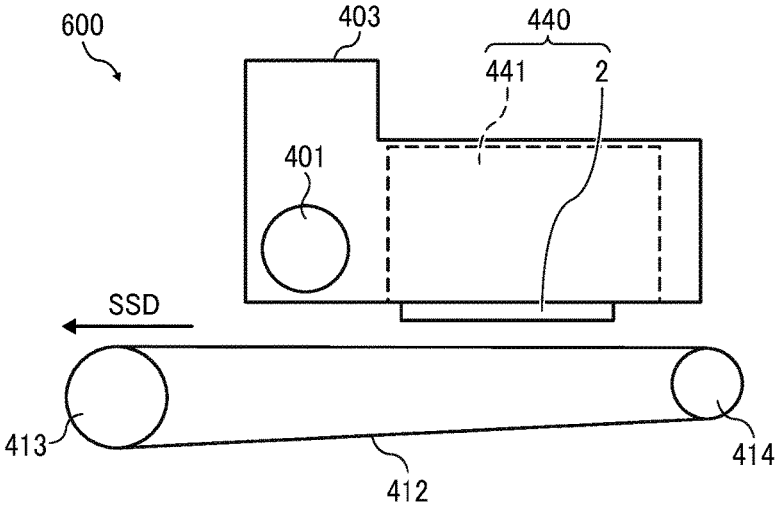
FIG. 23 is a side view of a portion of a liquid discharge apparatus according to an embodiment of the present disclosure.

FIGS. 22 and 23 illustrate an example of a liquid discharge apparatus 600 according to the present embodiment. FIG. 22 is a plan view of a main part of the liquid discharge apparatus 600. FIG. 23 is a side view of a main part of the liquid discharge apparatus 600.

The liquid discharge apparatus 600 is a serial-type apparatus in which a main scan moving unit 493 reciprocally moves a carriage 403 in a main scanning direction indicated by arrow MSD in FIG. 22. The main scan moving unit 493 includes a guide 401, a main scanning motor 405, a timing belt 408, etc. The guide 401 is laterally bridged between a left side plate 491A and a right side plate 491B and supports the carriage 403 so that the carriage 403 is movable along the guide 401. The main scanning motor 405 reciprocally moves the carriage 403 in the main scanning direction MSD via the timing belt 408 laterally bridged between a drive pulley 406 and a driven pulley 407.

The carriage 403 mounts a liquid discharge device 440 in which the head 2 according to the present embodiment and a head tank 441 are integrated as a single unit. The head 2 of the liquid discharge device 440 discharges color liquids of, for example, yellow (Y), cyan (C), magenta (M), and black (K). The head 2 includes nozzle arrays 51A and 51B, each including the plurality of nozzles 51 arrayed in row in a sub-scanning direction indicated by arrow SSD in FIG. 22. The sub-scanning direction (SSD) is perpendicular to the main scanning direction MSD and along the nozzle array direction NAD. The head 404 is mounted to the carriage 403 so that ink droplets are discharged downward.

The liquid stored outside the head 2 is supplied to the head 404 via a supply unit 494 that supplies the liquid from a liquid cartridge 450 to the head tank 441.

The supply unit 494 includes, e.g., a cartridge holder 451 as a mount part to mount a liquid cartridge 450, a tube 456, and a liquid feed unit 452 including a liquid feed pump. The liquid cartridge 450 is detachably attached to the cartridge holder 451. The liquid is supplied to the head tank 441 by the liquid feed unit 452 via the tube 456 from the liquid cartridge 450.

The liquid discharge apparatus 600 includes a conveyance unit 495 to convey a sheet 410. The conveyance unit 495 includes a conveyance belt 412 as a conveyor and a sub-scanning motor 416 to drive the conveyance belt 412.

The conveyance belt 412 attracts the sheet 410 and conveys the sheet 410 at a position facing the head 2. The conveyance belt 412 is in the form of an endless belt. The conveyance belt 412 is stretched between a conveyance roller 413 and a tension roller 414. The sheet 410 is attracted to the conveyance belt 412 by electrostatic force or air aspiration.

The conveyance roller 413 is rotated by a sub-scanning motor 416 via a timing belt 417 and a timing pulley 418, so that the conveyance belt 412 circulates in a sub-scanning direction (SSD) in FIG. 20.

At one side in the main scanning direction (MSD) of the carriage 403, a maintenance unit 420 to recover the head 2 in good condition is disposed on a lateral side (right-hand side) of the conveyance belt 412 in FIG. 20.

The maintenance unit 420 includes, for example, a cap 421 to cap a nozzle face of the head 2 and a wiper 422 to wipe the nozzle face. The nozzle face is a surface of the nozzle plate 50 in which the nozzles 51 are formed.

The main scan moving unit 493, the supply unit 494, the maintenance unit 420, and the conveyance unit 495 are mounted to a housing 491 that includes the left side plate 491A, the right side plate 491B, and a rear side plate 491C.

In the liquid discharge apparatus 600 thus configured, a sheet 410 is conveyed on and attracted to the conveyance belt 412 and is conveyed in the sub-scanning direction (SSD) by the cyclic rotation of the conveyance belt 412.

The head 2 is driven in response to image signals while the carriage 403 moves in the main scanning direction (MSD), to discharge liquid to the sheet 410 stopped, thus forming an image on the sheet 410.

As described above, the liquid discharge apparatus 600 includes the head 2 according to the present embodiment. Thus, the head 2 can discharge the liquid without a failure caused by a drive failure of the diaphragm 20 and have a stable discharge characteristic of the liquid. Therefore, the head 2 allows stable formation of high quality images.

[Liquid Discharge Device]

Figure 24:
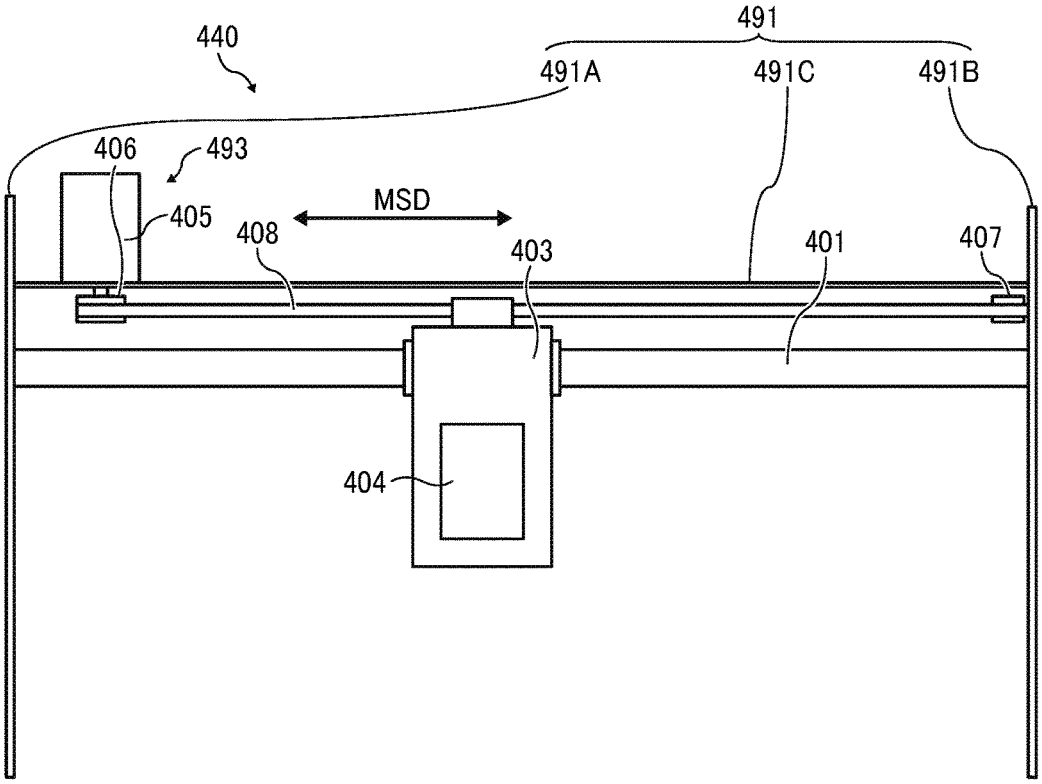
FIG. 24 is a plan view of a portion of a liquid discharge device according to an embodiment of the present embodiment.

FIG. 24 illustrates another example of the liquid discharge device 440 including the head 2 according to the present embodiment. FIG. 24 is a plan view of a main part of the liquid discharge device 440.

The liquid discharge device 440 includes the housing 491, the main scan moving unit 493, the carriage 403, and the head 2 among components of the liquid discharge apparatus 600. The left side plate 491A, the right side plate 491B, and the rear side plate 491C constitute the housing 491.

Note that, in the liquid discharge device 440, at least one of the maintenance unit 420 and the supply unit 494 described above may be mounted on, for example, the right side plate 491B.

Figure 25:
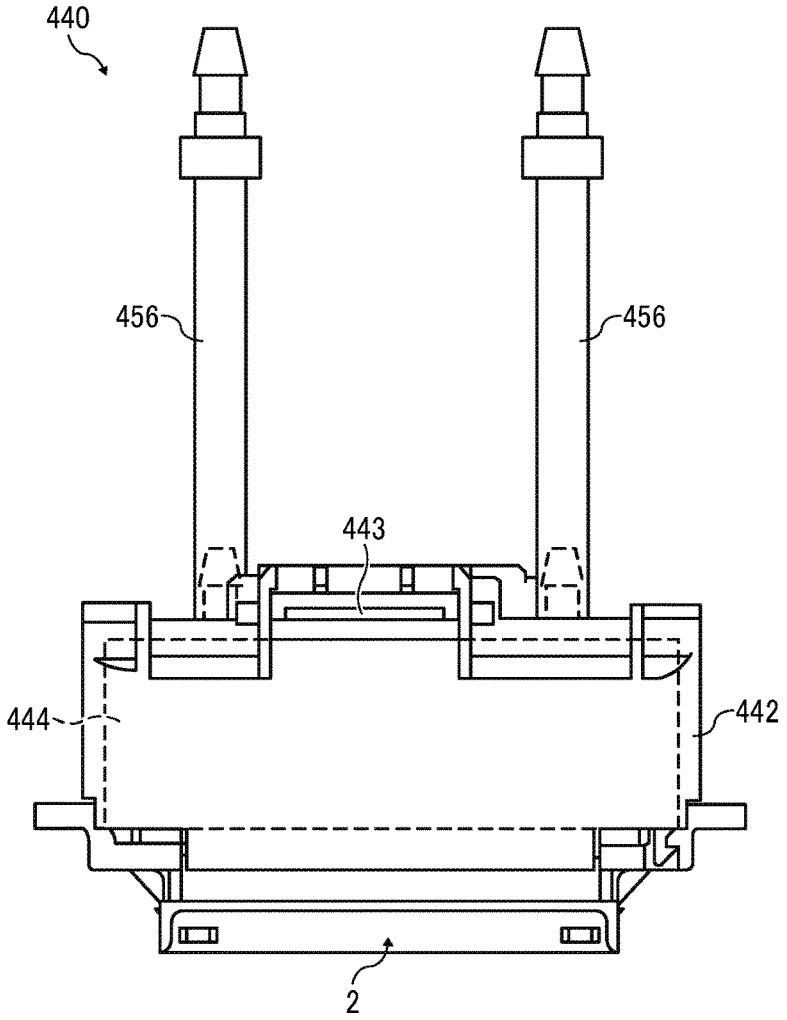
FIG. 25 is a front view of another example of the liquid discharge device.

FIG. 25 illustrates another example of the liquid discharge device 440 including the head 2 according to the present embodiment. FIG. 25 is a front view of the liquid discharge device 440.

The liquid discharge device 440 includes the head 2 to which a channel part 444 is mounted and a tube 456 connected to the channel part 444.

Further, the channel part 444 is disposed inside a cover 442. Instead of the channel part 444, the liquid discharge device 440 may include the head tank 441. A connector 443 to electrically connect the head 2 to a power source is disposed above the channel part 444.

In the above-described embodiments of the present disclosure, the "liquid discharge apparatus" includes the liquid discharge head or the liquid discharge device, and drives the liquid discharge head to discharge liquid. The liquid discharge apparatus may be, for example, an apparatus capable of discharging liquid to a material to which liquid can adhere and an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabricating apparatus to discharge a fabrication liquid to a powder layer in which powder material is formed in layers, so as to form a three-dimensional fabrication object.

In addition, "the liquid discharge apparatus" is not limited to such an apparatus to form and visualize meaningful images, such as letters or figures, with discharged liquid. For example, the liquid discharge apparatus may be an apparatus to form meaningless images, such as meaningless patterns, or fabricate three-dimensional images. The above-described term "material on which liquid can be adhered" represents a material on which liquid is at least temporarily adhered, a material on which liquid is adhered and fixed, or a material into which liquid is adhered to permeate.

Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

Examples of the material on which liquid can be adhered include any materials on which liquid can be adhered even temporarily, such as paper, thread, fiber, fabric, leather, metal, plastic, glass, wood, and ceramic.

Examples of the liquid are, e.g., ink, treatment liquid, DNA sample, resist, pattern material, binder, fabrication liquid, or solution and dispersion liquid including amino acid, protein, or calcium.

"The liquid discharge apparatus" may be an apparatus to relatively move a head and a medium on which liquid can be adhered. However, the liquid discharge apparatus is not limited to such an apparatus. For example, the liquid discharge apparatus may be a serial head apparatus that moves the liquid discharge head or a line head apparatus that does not move the liquid discharge head.

Examples of the "liquid discharge apparatus" further include a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials.

The "liquid discharge device" is an integrated unit including the liquid discharge head and a functional parts or mechanisms, and is an assembly of parts relating to liquid discharge. For example, the "liquid discharge device" may be a combination of the liquid discharge head with at least one of the head tank, the carriage, the supply unit, the maintenance unit, and the main scan moving unit.

Here, examples of the integrated unit include a combination in which the liquid discharge head and a functional part(s) are secured to each other through, e.g., fastening, bonding, or engaging, and a combination in which one of the liquid discharge head and a functional part(s) is movably held by another. The head may be detachably attached to the functional part(s) or unit(s) each other.

The liquid discharge device may be, for example, a liquid discharge device in which the liquid discharge head and the head tank are integrated as a single unit, such as the liquid discharge device 440 illustrated in FIG. 25. The liquid discharge head and the head tank may be connected each other via, e.g., a tube to integrally form the liquid discharge device. Here, a unit including a filter may further be added to a portion between the head tank and the head of the liquid discharge device.

The liquid discharge device may be an integrated unit in which a liquid discharge head is integrated with a carriage.

The liquid discharge device may be the liquid discharge head movably held by a guide that forms part of a main scan moving unit, so that the liquid discharge head and the main scan moving unit are integrated as a single unit. Like the liquid discharge device 440 illustrated in FIG. 24, the liquid discharge device may be an integrated unit in which the liquid discharge head, the carriage, and the main scan moving unit are integrally formed as a single unit.

In another example, the cap that forms part of the maintenance unit is secured to the carriage mounting the head so that the head, the carriage, and the maintenance unit are integrated as a single unit to form the liquid discharge device.

Like the liquid discharge device 440 illustrated in FIG. 25, the liquid discharge device may be an integrated unit in which the tube is connected to the liquid discharge head mounting the head tank or the channel part so that the liquid discharge head and the supply unit are integrally formed.

The main scan moving unit may be a guide only. The supply unit may be a tube(s) only or a mount part (loading unit) only.

In addition, "the liquid discharging head" has no specific limit to the pressure generator used in the liquid discharge head. The pressure generator is not limited to the piezoelectric actuator such as a laminate type piezoelectric element in the above-described embodiments, and may be, for example, a thermal actuator that employs a thermoelectric transducer element, such as a thermal resistor or an electrostatic actuator including a diaphragm and opposed electrodes.

The terms "image formation", "recording", "printing", "image printing", and "fabricating" used herein may be used synonymously with each other.

The embodiments described above are just preferred embodiments and the present disclosure is not limited thereto. Various modifications can be made without departing from the scope of the present disclosure.

For example, the upper electrode is an individual electrode and the lower electrode is a common electrode in the above-described embodiment. However, the present disclosure is not limited to this configuration. That is, the same effect can be obtained also in a configuration in which the upper electrode is a common electrode and the lower electrode is an individual electrode.

EXAMPLE

Hereinafter, Examples of the present disclosure is described.

Example 1

The diaphragm 20 was produced by preparing a 6-inch silicon wafer as the substrate 10, forming films of $SiO_2$ (film thickness 600 nm), Si (film thickness 200 nm), $SiO_2$ (film thickness 100 nm), SiN (film thickness 150 nm), $SiO_2$ (film thickness 130 nm), SiN (film thickness 150 nm), $SiO_2$ (film thickness 100 nm), Si (film thickness 200 nm), and $SiO_2$ (film thickness 600 nm) on the substrate 10 in the recited order.

Then, a titanium film (film thickness 20 nm) was formed as an adhesion layer on the diaphragm 20 by a sputtering apparatus at a deposition temperature of 350° C. Then, the adhesion layer is thermally oxidized at 750° C. using RTA (rapid thermal processing). Further, a platinum film (film thickness 160 nm) was formed on the adhesion layer by a sputtering apparatus at a film formation temperature of 400° C. to prepare a lower electrode 31.

Then, a solution adjusted so as to have a ratio of Pb:Ti=1:1 as a $PbTiO_3$ layer serving as a base layer and a solution adjusted so as to have a ratio of Pb:Zr:Ti=115:49:51 as an electromechanical transducer film 32 were prepared, and a film was formed by a spin coating method on the lower electrode 31.

For synthesis of a precursor coating liquid, lead acetate trihydrate, titanium isopropoxide, and zirconium isopropoxide were used as starting materials. Crystal water of lead acetate was dissolved in methoxyethanol and was then dehydrated. The amount of lead is excessively large for a stoichiometric composition. This is to prevent deterioration of crystallinity caused by so-called lead missing during heat treatment.

The titanium isopropoxide and the zirconium isopropoxide were dissolved in methoxyethanol, an alcohol exchange reaction and an esterification reaction were advanced, a resultant was mixed with a methoxyethanol solution having dissolved the lead acetate, and the PZT precursor solution was synthesized. The concentration of PZT was prepared to be 0.5 mol/l. A PT solution was produced in a similar manner to PZT. First, a PT layer film was formed by spin coating using these solutions. After film formation, the PT layer film was dried at 120° C. Thereafter, a film was formed by spin coating using the PZT solution, was dried at 120° C., and then was subjected to pyrolysis at 400° C.

After the thermal decomposition of the third layer, crystallization heat treatment (temperature 730° C.) is conducted by RTA. At this time, the film thickness of PZT was 240 nm. This step was performed eight times (24 layers) in total to obtain a PZT film thickness of about 2 μm as the electromechanical transducer film 32.

Subsequently, a $SrRuO_3$ film (film thickness 40 nm) was formed by sputtering as an oxide film of the upper electrode 33, and a Pt film (film thickness 125 nm) was formed by sputtering as a metal film. Then, a film was formed by the spin coating method using a photoresist (TSMR8800) manufactured by TOKYO OHKA KOGYO., LTD, a resist pattern was formed by a normal photolithographic method, and a pattern illustrated in FIGS. 4A and 4B was manufactured using an ICP etching device (manufactured by SAMCO INC.). Accordingly, the electromechanical transducer element 30 was produced on the diaphragm 20.

Subsequently, an $Al_2O_3$ film of 50 nm was formed on the electromechanical transducer element 30 using an ALD (Atomic Layer Deposition) method as the insulating protective film 40. As raw materials, TMA (Sigma-Aldrich Corporation) for Al and $O_3$ generated by an ozone generator for O were stacked alternately, and film formation was thereby performed.

Then, $SiO_2$ was formed to a thickness of 1000 nm by a plasma CVD method as the insulating protective film 40*b*, and then a contact hole H was formed by etching as illustrated in FIG. 4B. Thereafter, a film of Al was formed by sputtering. The film of Al was patterned by etching to form the wiring 60. A film of $Si_3N_4$ was formed on the wiring 60 by plasma CVD to have a film thickness of 500 nm as the insulating protective film 70. Then, an opening 70*x* is formed in the insulating protective film 70 so that a part of the wiring 60 is exposed to form the electrode pads 61, 62, and 63 as illustrated in FIGS. 4A and 4B. Note that the electrode pad 61 is a common electrode pad, the electrode pads 62 and 63 are individual electrode pads, and the distance between the individual electrode pads is 80 μm.

Thereafter, as illustrated in FIGS. 16A and 16B, the back surface of the substrate 10 was etched to form the pressure chamber 10X (X2: width 60 μm, Y2: length 1000 μm), thereby forming a liquid discharge head 2. However, the nozzle plate 50 including the nozzles 51 is not joined (bonded) to the lower portion of the substrate 10, and the head 2 is in a semifinished state.

Figure 26:
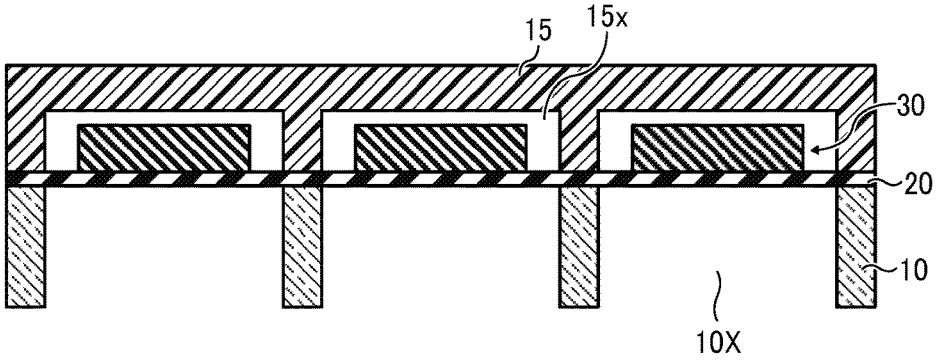
FIG. 26 is a cross-sectional view of the liquid discharge head to which a holding substrate is bonded.

At this time, as illustrated in FIG. 26, the holding substrate 15 was used to hold the pressure chamber 10X. The holding substrate 15 includes recesses 15*x* on a back surface of the holding substrate 15. A number of recesses 15*x* in the holding substrate 15 corresponds to a number of electromechanical transducer elements 30 in the head 2. Specifically, the holding substrate 15 was bonded to the substrate 10 via an adhesive layer before forming the pressure chamber 10X in the substrate 10 so that electromechanical transducer elements 30 were accommodated in the recesses 15*x*, respectively. Then, the back surface of the substrate 10 was etched to form the pressure chamber 10X.

At this time, one dummy channel 4 is formed while forming the escape groove 11 (X1: width 60 μm, Y1: length 60 μm). The number of dummy channels 4 is counted for the dummy channels 4 formed on one end side of the pressure chambers 10X, and the same applies hereinafter. The interval between the adjacent escape grooves 11 was 60 μm in both the X-direction and the Y-direction. The distance Z between the escape groove 11 and the dummy channel 4 was set to 60 μm.

Example 2

The head 2 was produced in the same manner as in the Example 1 except that $SiO_2$ was formed to a thickness of 800 nm as the insulating protective film 40*b*, $Si_3N_4$ was formed to have a thickness of 600 nm by the plasma CVD method, and four dummy channels 4 were formed.

Example 3

The diaphragm 20 was produced by preparing a 6-inch silicon wafer as the substrate 10, forming films of $SiO_2$ (film thickness 1200 nm), Si (film thickness 400 nm), $SiO_2$ (film thickness 200 nm), SiN (film thickness 300 nm), $SiO_2$ (film thickness 260 nm), SiN (film thickness 300 nm), $SiO_2$ (film thickness 200 nm), Si (film thickness 400 nm), and $SiO_2$ (film thickness 1200 nm) on the substrate 10 in the recited order.

The escape groove 11 (X1: width 100 μm, Y1: length 100 μm) was formed while forming four dummy channels 4 by setting the width of the pressure chamber 10X at 100 μm. The interval between the adjacent escape grooves 11 was 30 μm in both the X-direction and the Y-direction. Further, the distance between the escape groove 11 and the dummy channel 4 was set to 30 μm. The head 2 was produced in the same manner as in Example 1 except the conditions as described above.

Example 4

As illustrated in FIG. 7, the head 2 was produced as in the same manner in Example 1 except that the back surface of the substrate 10 was etched to prepare the pressure chamber 10X (no dummy channel was formed), and the distance between the endmost drive channel 3 and the escape groove 11 was 100 μm.

Example 5

As illustrated in FIG. 18, the head 2 was produced as in the same manner in Example 1 except that the back surface of the substrate 10 was etched to form the pressure chamber 10X and four dummy channels 4, and the substrate 10 at the escape groove 11 is half-etched to have a non-penetration structure as illustrated in FIG. 18A.

Example 6

The head 2 was produced in the same manner as in the Example 1 except that $SiO_2$ was formed to a thickness of 1200 nm by the plasma CVD method as the insulating protective film 40*b*, $Si_3N_4$ was formed to have a thickness of 400 nm by the plasma CVD method, and four dummy channels 4 were formed.

Comparative Example 1

The head 2 was produced in the same manner as in the Example 1 except that $SiO_2$ was formed to a thickness of 1500 nm by the plasma CVD method as the insulating protective film 40*b*, $Si_3N_4$ was formed to have a thickness of 100 nm by the plasma CVD method, the pressure chambers 10X were formed by etching the back surface of the substrate 10, and the escape groove 11 was not formed.

Comparative Example 2

As illustrated in FIG. 10, the head 2 was manufactured in the same manner as in Example 1 except that the back surface of the substrate 10 was etched to prepare the pressure chamber 10X, and the escape groove 11 was not formed.

[Consideration on Examples 1 to 6 and Comparative Examples 1 and 2]

The heads 2 prepared in Examples 1 to 6 and Comparative Examples 1 and 2 were evaluated for nozzle bonding property and liquid filling property. FIGS. 27A and 27B illustrate an evaluation results and details of each Examples and Comparative Examples.

In FIGS. 27A and 27B, in each Examples 1 to 6, the difference between the maximum value and the minimum value of the curvature radius R (the difference in curvature radius) of the diaphragm 20 in each groups of the drive channels 3 from the end of the drive channels (first channel) to twenty channels is 1500 μm or less. Conversely, in Comparative Example 1, the difference in curvature radius is 2500 μm that is larger than 2000 μm.

As can be seen from FIGS. 27A and 27B, in each Examples 1 to 6, the difference in displacement ($\Delta\delta/\delta_ave$) is within 8% that is a targeted value of a displacement gradient in each groups of the drive channels from the end of the drive channels (first channel) to twenty channels. However, in the Comparative Example 1, the difference in displacement ($\Delta\delta/\delta_ave$) was 13% having a large variation. Note that $\delta$ is the displacement characteristic of the electromechanical transducer film 32 when the evaluation is performed by applying an electric field strength of 150 kv/cm. $\Delta\delta$ is the slope difference of the displacement characteristic $\delta$ with respect to the arrangement direction of the electromechanical transducer film 32. $\delta_ave$ is an average value of the displacement characteristics $\delta$.

The nozzle plate 50 including the nozzles 51 is joined (bonded) to the lower part of the substrate 10 of each of the heads 2 (semifinished head 2) produced in Examples 1 to 6 and Comparative Example 1 to complete the production of the heads 2. Then, a discharge evaluation test was performed for each of the heads 2.

Specifically, discharge condition was confirmed while applying a voltage from −10 V to −30 V by a simple push waveform using the ink whose viscosity was adjusted to 5 cp. As a result, in Comparative Examples 1 and 2 in which the escape groove 11 is not formed, a problem was confirmed such as the adhesive entering the pressure chamber 10X at the time of joining (bonding) the nozzle plate 50 to the substrate 10 (see nozzle bonding property "POOR" in FIG. 25B).

On the other hand, in each of the heads 2 produced in Examples 1 to 6 in which the escape grooves 11 were formed, good nozzle bonding property was obtained (see nozzle bonding property "EXCELLENT" in FIG. 25B). In addition, it was confirmed that providing the dummy channels 4 in Examples 1 to 3, 5, and 6 can improve the filling property of the liquid to the head 2 and to solve discharge troubles caused by air bubbles, for example. Hereinafter, Examples of a fifth embodiment and a sixth embodiment according to the present disclosure is described.

Example 7

The diaphragm 20 was produced by preparing a 6-inch silicon wafer as the substrate 10, forming films of $SiO_2$ (film thickness 600 nm), Si (film thickness 200 nm), $SiO_2$ (film thickness 100 nm), SiN (film thickness 150 nm), $SiO_2$ (film thickness 130 nm), SiN (film thickness 150 nm), $SiO_2$ (film thickness 100 nm), Si (film thickness 200 nm), and $SiO_2$ (film thickness 600 nm) on the substrate 10 in the recited order.

Then, a titanium film (film thickness 20 nm) was formed as an adhesion layer on the diaphragm 20 by a sputtering apparatus at a deposition temperature of 350° C. Then, the adhesion layer is thermally oxidized at 750° C. using RTA (rapid thermal processing). Further, a platinum film (film thickness 160 nm) was formed on the adhesion layer by a sputtering apparatus at a film formation temperature of 400° C. to prepare a lower electrode 31.

Then, a solution adjusted so as to have a ratio of Pb:Ti=1:1 as a $PbTiO_3$ layer serving as a base layer and a solution adjusted so as to have a ratio of Pb:Zr:Ti=115:49:51 as an electromechanical transducer film 32 were prepared, and a film was formed by a spin coating method on the lower electrode 31.

For synthesis of a precursor coating liquid, lead acetate trihydrate, titanium isopropoxide, and zirconium isopropoxide were used as starting materials. Crystal water of lead acetate was dissolved in methoxyethanol and was then dehydrated. The amount of lead is excessively large for a stoichiometric composition. This is to prevent deterioration of crystallinity caused by so-called lead missing during heat treatment.

The titanium isopropoxide and the zirconium isopropoxide were dissolved in methoxyethanol, an alcohol exchange reaction and an esterification reaction were advanced, a resultant was mixed with a methoxyethanol solution having dissolved the lead acetate, and the PZT precursor solution was synthesized. The concentration of PZT was prepared to be 0.5 mol/l. A PT solution was produced in a similar manner to PZT. First, a PT layer film was formed by spin coating using these solutions. After film formation, the PT layer film was dried at 120° C. Thereafter, a film was formed by spin coating using the PZT solution, was dried at 120° C., and then was subjected to pyrolysis at 400° C.

After the thermal decomposition of the third layer, crystallization heat treatment (temperature 730° C.) is conducted by RTA. At this time, the film thickness of PZT was 240 nm. This step was performed eight times (24 layers) in total to obtain a PZT film thickness of about 2 μm as the electromechanical transducer film 32.

Subsequently, a $SrRuO_3$ film (film thickness 40 nm) was formed by sputtering method as an oxide electrode film constituting the upper electrode 33, and a Pt film (film thickness 125 nm) was formed by sputtering as a metal film. Then, a film was formed by the spin coating method using a photoresist (TSMR8800) manufactured by TOKYO OHKA KOGYO., LTD, a resist pattern was formed by a normal photolithographic method, and a pattern illustrated in FIGS. 4A and 4B was manufactured using an ICP etching device (manufactured by SAMCO INC.). Accordingly, the electromechanical transducer element 30 was produced on the diaphragm 20.

Subsequently, an $Al_2O_3$ film of 50 nm was formed using an ALD (Atomic Layer Deposition) method as the insulating protective film 40 on the electromechanical transducer element 30. As raw materials, TMA (Sigma-Aldrich Corporation) for Al and $O_3$ generated by an ozone generator for O were stacked alternately, and film formation was thereby performed.

Then, a film of $Si_3N_4$ was formed to a thickness of 1000 nm by a plasma CVD method as the insulating protective film 40*b*, and then a contact hole H was formed by etching as illustrated in FIG. 4B. Thereafter, a film of Al was formed by sputtering. The film of Al was patterned by etching to form the wiring 60. A film of $Si_3N_4$ was formed on the wiring 60 by plasma CVD to have a film thickness of 500 nm as the insulating protective film 70.

Thereafter, as illustrated in FIGS. 16A and 16B, the back surface of the substrate 10 was etched to form the pressure chamber 10X (X2: width 60 μm, Y2: length 1000 μm), thereby forming the head 2. However, the nozzle plate 50 including the nozzles 51 is not joined (bonded) to the lower portion of the substrate 10, and the head 2 is in a semifinished state.

At this time, as illustrated in FIG. 26, the holding substrate 15 was used to hold the pressure chamber 10X. The holding substrate 15 includes recesses 15*x* on a back surface of the holding substrate 15. A number of recesses 15*x* in the holding substrate 15 corresponds to a number of electromechanical transducer elements 30 in the head 2. Specifically, the holding substrate 15 was bonded to the substrate 10 via an adhesive layer before forming the pressure chamber 10X in the substrate 10 so that electromechanical transducer elements 30 were accommodated in the recesses 15*x*, respectively. Then, the back surface of the substrate 10 was etched to form the pressure chamber 10X.

At this time, one dummy channel 4 is formed while forming the escape groove 11 (X1: width 60 μm, Y1: length 60 μm). The number of dummy channels 4 is counted for the dummy channels 4 formed on one end side of the pressure chambers 10X, and the same applies hereinafter. The interval between the adjacent escape grooves 11 was 60 μm in both the X-direction and the Y-direction. The distance Z between the escape groove 11 and the dummy channel 4 was set to 60 μm. The radius of curvature of the groove 11 was 2300 μm, and the radius of curvature of the end side of the drive channel 3 was 4500 μm.

Example 8

The head 2 was produced in the same manner as in the Example 7 except that $Si_3N_4$ was formed to a thickness of 700 nm by the plasma CVD method as the insulating protective film 40*b*, $Si_3N_4$ was formed to have a thickness of 300 nm by the plasma CVD method as the insulating protective film 70, and four dummy channels 4 were formed. The radius of curvature of the escape groove 11 was 6400 μm, and the radius of curvature of the diaphragm 20 at the end side of the drive channels 3 was 4200 μm.

Example 9

The diaphragm 20 was produced by preparing a 6-inch silicon wafer as the substrate 10, forming films of $SiO_2$ (film thickness 1200 nm), Si (film thickness 400 nm), $SiO_2$ (film thickness 200 nm), SiN (film thickness 300 nm), $SiO_2$ (film thickness 260 nm), SiN (film thickness 300 nm), $SiO_2$ (film thickness 200 nm), Si (film thickness 400 nm), and $SiO_2$ (film thickness 1200 nm) on the substrate 10 in the recited order.

The head 2 was produced in the same manner as in the Example 7 except that $Si_3N_4$ was formed to a thickness of 700 nm by the plasma CVD method as the insulating protective film 40*b*, $Si_3N_4$ was formed to have a thickness of 300 nm by the plasma CVD method as the insulating protective film 70, a width of the pressure chambers 10X is 100 μm, and four dummy channels 4 were formed. Further, the escape grooves 11 (X1: width 100 μm, Y1: length 100 μm) were formed. The interval between the adjacent escape grooves 11 was 30 μm in both the X-direction and the Y-direction. Further, the distance between the escape groove 11 and the dummy channel 4 was set to 30 μm. The head 2 was produced in the same manner as in Example 7 except the conditions as described above. The radius of curvature of the escape groove 11 was 6200 μm, and the curvature radius of the end side of the drive channel 3 was 4250 μm.

Example 10

As illustrated in FIG. 7, the back surface of the substrate 10 was etched to prepare a pressure chamber 10X (dummy channel not formed), a film of $Si_3N_4$ was formed to 700 nm as an insulating protective film 40*b* by a plasma CVD method. Further, a film of $Si_3N_4$ was formed as the insulating protective film 70 by 300 nm by a plasma CVD method. The head 2 was manufactured in the same manner as in Example 7 except that the distance between the endmost drive channel 3 and the escape groove 11 was set to 100 μm. The radius of curvature of the escape groove 11 was 6500 μm, and the radius of curvature of the end side of the drive channels 3 was 4300 μm.

Example 11

As illustrated in FIG. 18, the head 2 was produced as in the same manner in Example 7 except that the back surface of the substrate 10 was etched to form the pressure chambers 10X and four dummy channels 4, and the substrate 10 at the escape groove 11 is half-etched to have a non-penetration structure as illustrated in FIG. 18A. The radius of curvature of the drive channel 3 at the end was 4400 μm.

Comparative Example 3

The head 2 was produced in the same manner as in the Example 7 except that $Si_3N_4$ was formed to a thickness of 1500 nm by the plasma CVD method as the insulating protective film 40*b*, $Si_3N_4$ was formed to have a thickness of 1000 nm by the plasma CVD method as the insulating protective film 70, and the pressure chambers 10X and four dummy channels 4 were formed by etching the back surface of the substrate 10. The radius of curvature of the escape groove 11 was 1200 μm, and the radius of curvature of the end side of the drive channels 3 was 4600 μm.

Comparative Example 4

As illustrated in FIG. 9, the head 2 was manufactured in the same manner as in Example 7 except that the back surface of the substrate 10 was etched to prepare the pressure chamber 10X, and the escape grooves 11 and the dummy channels 4 were not formed. The radius of curvature of the end side of the drive channel 3 was 4350 μm.

[Consideration on Examples 7 to 11 and Comparative Examples 3 and 4]

The heads 2 prepared in Examples 7 to 11 and Comparative Examples 3 and 4 were evaluated for nozzle bonding property and liquid filling property. Evaluation results and details of each Examples and Comparative Examples are illustrated in FIGS. 28A and 28B.

In FIGS. 28A and 28B, in each Examples 7 to 11, the difference between the maximum value and the minimum value of the curvature radius R (the difference in curvature radius) of the diaphragm 20 in each groups of the drive channels 3 from the end of the drive channels 3 (first channel) to twenty channels is 1500 μm or less. Conversely, in Comparative Example 3, the difference in curvature radius is 2500 μm that is larger than 2000 μm. In Comparative Example 3, the radius of curvature of the escape groove 11 is smaller than the radius of curvature of the drive channel 3.

As can be seen from FIGS. 28A and 28B, in each Examples 7 to 11, the difference in displacement (Δδ/δ_ave) is within 8% that is a targeted value of a displacement gradient in each groups of the drive channels 3 from the end of the drive channels 3 (first channel) to twenty channels. However, in the Comparative Example 3, the difference in displacement (Δδ/δ_ave) was 13% having a large variation. Note that δ is the displacement characteristic of the electromechanical transducer film 32 when the evaluation is performed by applying an electric field strength of 150 kv/cm. Δδ is the slope difference of the displacement characteristic δ with respect to the arrangement direction of the electromechanical transducer film 32. δ_ave is an average value of the displacement characteristics δ.

The nozzle plate 50 including the nozzles 51 is joined (bonded) to the lower part of the substrate 10 of each of the heads 2 (semifinished head 2) produced in Examples 7 to 11 and Comparative Example 3 to complete the production of the heads 2. Then, a discharge evaluation test was performed for each of the heads 2.

Specifically, discharge condition was confirmed while applying a voltage from −10V to −30V by a simple push waveform using the ink whose viscosity was adjusted to 5 cp. As a result, in Comparative Examples 4 in which the escape groove 11 is not formed, a problem was confirmed such as the adhesive entering the pressure chamber 10X at the time of joining (bonding) the nozzle plate 50 to the substrate 10 (see nozzle bonding property "POOR" in FIG. 28B).

On the other hand, in each of the heads 2 produced in Examples 7 to 11 in which the escape grooves 11 were formed, good nozzle bonding property was obtained (see nozzle bonding property "EXCELLENT" in FIG. 28B). In addition, it was confirmed that providing the dummy channels 4 in Examples 7 to 9 and 11 can improve the filling property of the liquid to the head 2 and to solve discharge troubles caused by air bubbles, for example. In Examples 8 and 9 in which the radius of curvature of the groove 11 was made larger than the radius of curvature of the drive channel 3, it was confirmed that the filling property is better than in Example 7 in which the radius of curvature of the groove 11 is smaller than the radius of curvature of the drive channel 3 (see filling property "EXCELLENT" in FIG. 28B).

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head, comprising:

a plurality of nozzles from which a liquid is discharged;

a plurality of pressure chambers communicating with the plurality of nozzles, respectively;

a substrate in which the plurality of pressure chambers is arranged in a predetermined direction;

a diaphragm provided on a first side of the substrate opposite a second side of the substrate facing the plurality of nozzles, the diaphragm forming walls of the plurality of pressure chambers; and a plurality of electromechanical transducer elements provided on the diaphragm corresponding to the plurality of pressure chambers, respectively, wherein a groove is formed in the substrate on an end side of the plurality of pressure chambers in the predetermined direction, the groove includes an opening that opens toward a direction opposite to the diaphragm, the diaphragm at the plurality of pressure chambers is formed to be deflexed toward the plurality of pressure chambers, the diaphragm at the groove is formed to be deflexed opposite to the opening of the groove, and a degree of deflection of the diaphragm at the plurality of pressure chambers is larger than a degree of deflection of the diaphragm at the groove.

2. The liquid discharge head according to claim 1, wherein each of the degree of deflection of the diaphragm at the plurality of pressure chambers and the degree of deflection of the diaphragm at the groove is determined by a radius of curvature R, wherein a radius of curvature Ra of the diaphragm at the groove is larger than a radius of curvature Rb of the diaphragm at the plurality of pressure chambers.

3. The liquid discharge head according to claim 1, wherein the degree of deflection of the diaphragm is determined by an amount of deflection of the diaphragm, and an amount of deflection of the diaphragm at the groove is smaller than an amount of deflection of the diaphragm at the plurality of the pressure chambers.

4. The liquid discharge head according to claim 1, wherein the groove does not penetrate the substrate.

5. The liquid discharge head according to claim 1, further comprising a dummy pressure chamber provided between the groove and the plurality of pressure chambers in the predetermined direction, wherein the dummy pressure chamber does not include a nozzle from which the liquid is discharged.

6. The liquid discharge head according to claim 1, further comprising a wiring formed on a first side of the diaphragm opposite a second side of the diaphragm facing the groove.

7. The liquid discharge head according to claim 1, wherein a size X1 of the groove in an X-direction along the predetermined direction is equal to or smaller than a size X2 of each of the pressure chambers in the X-direction, and a size Y1 of the groove in a Y-direction perpendicular to the X-direction in a plane of the substrate is smaller than a size Y2 of each of the pressure chambers in the Y-direction.

8. A liquid discharge device comprising the liquid discharge head according to claim 1.

9. A liquid discharge apparatus comprising the liquid discharge head according to claim 1.

10. A liquid discharge head, comprising:

a plurality of nozzles from which a liquid is discharged;

a plurality of pressure chambers communicating with the plurality of nozzles, respectively;

a substrate in which the plurality of pressure chambers is arranged in a predetermined direction;

a diaphragm provided on a first side of the substrate opposite a second side of the substrate facing the plurality of nozzles, the diaphragm forming walls of the plurality of pressure chambers; and a plurality of electromechanical transducer elements provided on the diaphragm corresponding to the plurality of pressure chambers, respectively, wherein a groove is formed in the substrate on an end side of the plurality of pressure chambers in the predetermined direction, the groove includes an opening that opens toward a direction opposite to the diaphragm, the diaphragm at the groove is formed to be deflexed opposite to the opening of the groove, and a radius of curvature Ra of the diaphragm at the groove is equal to or larger than 5000 μm.

11. The liquid discharge head according to claim 10, further comprising a dummy pressure chamber provided between the groove and the plurality of pressure chambers in the predetermined direction, wherein the dummy pressure chamber does not include a nozzle from which the liquid is discharged.

12. The liquid discharge head according to claim 10, wherein a size X1 of the groove in an X-direction along the predetermined direction is equal to or smaller than a size X2 of each of the pressure chambers in the X-direction, and a size Y1 of the groove in a Y-direction perpendicular to the X-direction in a plane of the substrate is smaller than a size Y2 of each of the pressure chambers in the Y-direction.

13. A liquid discharge apparatus comprising the liquid discharge head according to claim 10.

14. A liquid discharge head, comprising:

a plurality of nozzles from which a liquid is discharged;

a plurality of pressure chambers communicating with the plurality of nozzles, respectively;

a substrate in which the plurality of pressure chambers is arranged in a predetermined direction;

a diaphragm provided on a first side of the substrate opposite a second side of the substrate facing the plurality of nozzles, the diaphragm forming walls of the plurality of pressure chambers; and a plurality of electromechanical transducer elements provided on the diaphragm corresponding to the plurality of pressure chambers, respectively, wherein a groove is formed in the substrate on an end side of the plurality of pressure chambers in the predetermined direction, the groove includes an opening that opens toward a direction opposite to the diaphragm, the diaphragm at the plurality of pressure chambers is formed to be deflexed toward the plurality of pressure chambers, and the diaphragm at the groove is formed to be deflexed opposite to the opening of the groove.

15. The liquid discharge head according to claim 14, wherein a radius of curvature Ra of the diaphragm at the groove is equal to or larger than 2000 μm.

16. The liquid discharge head according to claim 14, further comprising a dummy pressure chamber provided between the groove and the plurality of pressure chambers in the predetermined direction, wherein the dummy pressure chamber does not include a nozzle from which the liquid is discharged.

17. The liquid discharge head according to claim 14, wherein a degree of deflection of the diaphragm at each of the plurality of pressure chambers is larger than a degree of deflection of the diaphragm at the groove.

18. The liquid discharge head according to claim 14, wherein a first insulating protective film, a wiring, and a second insulating protective film are formed on the diaphragm at the groove in a recited order.

19. The liquid discharge head according to claim 18, wherein the first insulating protective film and a second insulating protective film are made of material having tensile stress.

20. A liquid discharge apparatus comprising the liquid discharge head according to claim 14.

* * * * *